US009374874B1

(12) United States Patent
Ewing

(10) Patent No.: US 9,374,874 B1
(45) Date of Patent: Jun. 21, 2016

(54) LIGHTING CONTROL SYSTEMS AND METHODS

(71) Applicant: David B. Ewing, Madison, AL (US)

(72) Inventor: David B. Ewing, Madison, AL (US)

(73) Assignee: Synapse Wireless, Inc., Huntsville, AL (US)

( * ) Notice: Subject to any disclaimer, the term of this patent is extended or adjusted under 35 U.S.C. 154(b) by 339 days.

(21) Appl. No.: 13/776,641

(22) Filed: Feb. 25, 2013

Related U.S. Application Data

(60) Provisional application No. 61/603,033, filed on Feb. 24, 2012, provisional application No. 61/606,407, filed on Mar. 3, 2012.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl.
CPC ..... *H05B 37/0272* (2013.01)

(58) Field of Classification Search
CPC ..... H01R 33/94; H05B 39/06; B23K 11/248; B60Q 1/1415; G07F 5/00
USPC ..... 315/291, 292
See application file for complete search history.

(56) References Cited

U.S. PATENT DOCUMENTS 7,242,152 B2 * 7/2007 Dowling et al. ..... 315/291
2008/0316730 A1 * 12/2008 Diederiks ..... G06F 3/0481 362/85

* cited by examiner

*Primary Examiner* — Lincoln Donovan
*Assistant Examiner* — Diana J Cheng
(74) *Attorney, Agent, or Firm* — Maynard Cooper & Gale, P.C.; Jon E. Holland

(57) ABSTRACT

Each light source to be controlled by a lighting control system is associated with a light identifier, and the light sources can be installed in any desired manner without regard to which light identifier is mapped to which light source by the system. After installation, a user provides inputs for mapping each light to its appropriate identifier. Accordingly, the installation process is simplified, and errors that otherwise could arise by an installer incorrectly installing light sources relative to the light identifier mappings used by the system are prevented.

30 Claims, 10 Drawing Sheets

LIGHTING CONTROL SYSTEMS AND METHODS

CROSS REFERENCE TO RELATED APPLICATIONS

This application claims priority to U.S. Provisional Patent Application No. 61/603,033, entitled "Lighting Control Systems and Methods," and filed on Feb. 24, 2012, which is incorporated herein by reference. This application also claims priority to U.S. Provisional Patent Application No. 61/606,407, entitled "Lighting Control Systems and Methods with Daylight Harvesting and Driver Linearization," and filed on Mar. 3, 2012, which is incorporated herein by reference.

RELATED ART

Lighting control systems are used in a wide variety of commercial and residential applications. Lighting control systems typically comprise wired or wireless local networks. Wired lighting control systems require each light source in the system to be physically connected to its respective switch, controller and/or power source via a plurality of wires. Installation and management of such systems is often difficult and time-consuming, especially in systems with a large number of light sources, due to the need for installers to know how the entire system will work at the time of installation and the difficulty in making changes to the system.

Wireless lighting control systems, on the other hand, do not require physical connections between the controller, the switch and the light source. Instead, the light source often has a lighting controller coupled to it, and the lighting controller communicates wirelessly with the other components in the lighting control system. Configuration and management of wireless control systems are often difficult, however, particularly in applications where the system comprises a large number of light sources. As an example, control systems typically use light identifiers to properly control the light sources in a desired manner, and such identifiers must be properly mapped to the physical light sources. The installer typically installs the light sources in a predefined configuration or with knowledge of each light source's identifier in order to ensure correct mapping of the light identifiers to the light sources. The process of ensuring that each light source is mapped to its proper identifier is burdensome and time consuming, and if a light source is improperly mapped to a wrong identifier, the system may operate incorrectly.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

Embodiments of the present disclosure generally pertain to lighting control systems and methods. In one exemplary embodiment, an installer installs light sources (e.g., light emitting diodes) in any desired manner without regard to which light identifier is mapped to which light source by the control system. After installation, a user provides inputs for mapping each light to its appropriate identifier. In this regard, the system allows a user to provide an input that is used by the system to select a light identifier. In response to such input, the system automatically changes a state of the identified light source thereby providing feedback to the user as to whether the selected identifier corresponds to a light source of interest to the user. The user may then provide an input confirming that the selected light identifier pertains to the light source of interest. Thus, the system is able to identify the light source of interest without requiring installation of the light sources in any predefined configuration and without requiring the installer to have any knowledge of the light identifiers. Accordingly, the installation process is simplified, and errors that otherwise could arise by an installer incorrectly installing light sources relative to the light identifier mappings used by the system are prevented.

Figure 1:
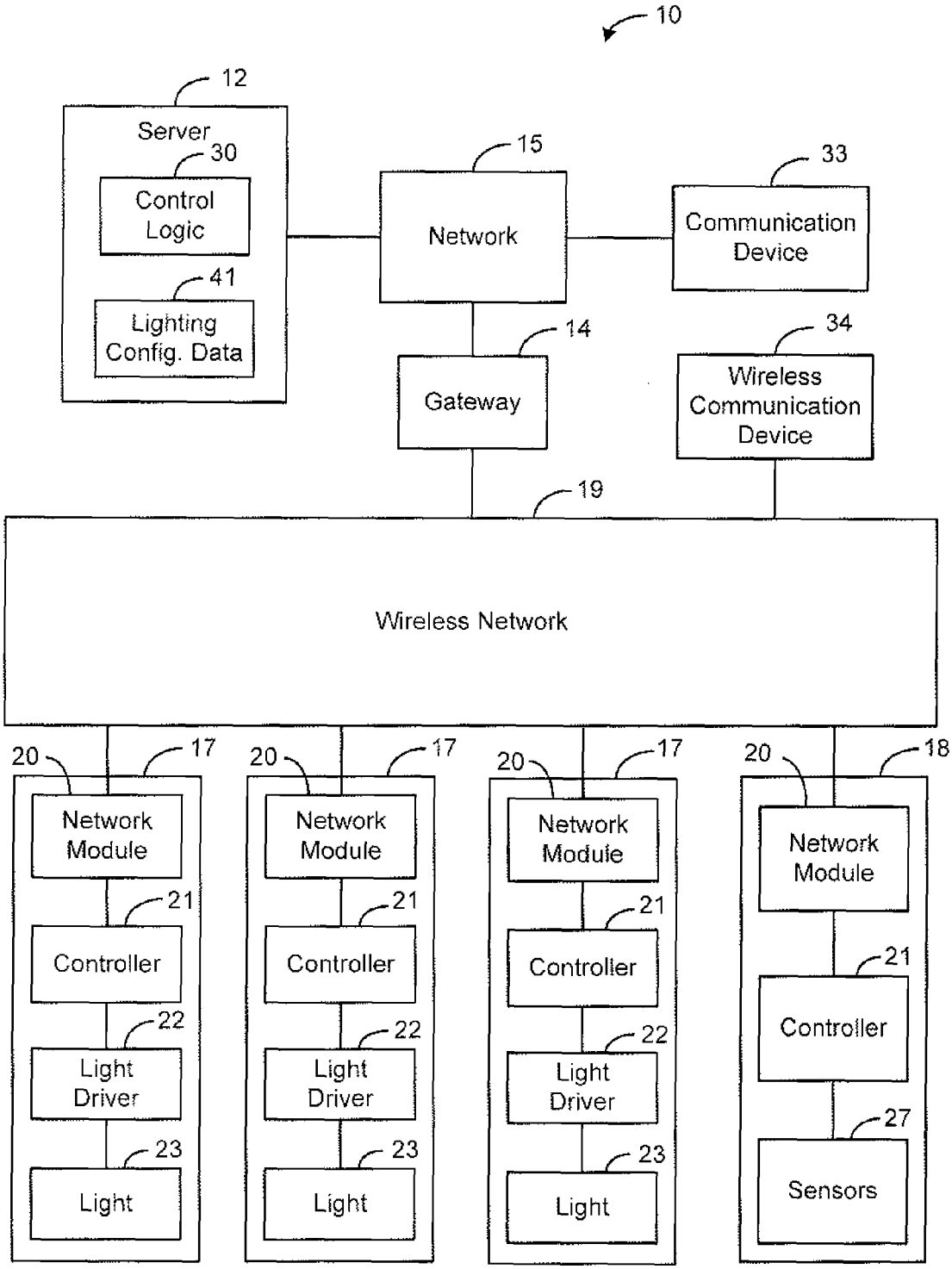
FIG. 1 is a block diagram illustrating an exemplary lighting control system in accordance with the present disclosure.

FIG. 1 depicts an exemplary embodiment of a lighting control system 10. The system 10 comprises a server 12 coupled to a gateway 14 via a network 15. In one embodiment, the network 15 comprises a wide area network (WAN), such as, for example, the Internet, but different types of networks are possible in other embodiments. The gateway 14 is coupled to a plurality of lighting elements 17 and a plurality of sensor elements 18 via a wireless network 19. In other embodiments, it is unnecessary for the network 19 to be wireless.

In one embodiment, each lighting element 17 comprises a network module 20, a controller 21, a light driver 22, and at least one light source 23. The controller 21 is configured to control the operation of the element 17, and the light driver 22 is configured to supply electrical current to the light source 23 based on control signals from the controller 21. In one embodiment, the light source 23 comprises a light emitting diode (LED) and the light driver 22 comprises an LED driver, but different types of light sources 23 and light drivers 22 are possible in other embodiments.

Each sensor element 18 comprises a network module 20, a controller 21, and at least one sensor 27, such as, for example, a switch, a motion sensor, or a light sensor, and the controller 21 is configured to control the operation of the element 18. Note that only one light source 23 is shown in each lighting element 17 and only one sensor 27 is shown in each sensor element 18 for illustrative purposes, but any number of light sources 23 and sensors 27 may be utilized in each element 17 and 18, respectively, in other embodiments. Further, the controller 21 of any element 17 or 18 may be coupled to and control both a light source 23 and a sensor 27, if desired.

In one embodiment, each lighting element 17 and sensor element 18 defines a respective node of the wireless network 19 and is separately addressable via a respective network identifier that identifies the node from other nodes of the network 19. The network module 20 of each respective element 17 or 18 handles network communications, including reception and transmission of messages via the network 19. In one embodiment, the network 19 is an ad hoc, mesh network that transmits wireless radio frequency (RF) signals among the nodes of the network 19, but other types of networks and other frequency ranges are possible in other embodiments. Exemplary techniques for wirelessly communicating among nodes of an ad hoc mesh network are described in commonly-assigned U.S. patent application Ser. No. 12/463,044, entitled "Systems and Methods for Selectively Disabling Routing Table Purges in Wireless Networks" and filed on May 8, 2009, which is incorporated herein by reference, and the network 19, including the network modules 20, may be configured to communicate via such techniques.

The server 12 comprises control logic 30 for generally controlling the operation of the server 12. The control logic 30 is configured to communicate with the lighting elements 17 and the sensor elements 18 via the network 15 and the wireless network 19 and to configure the elements 17 and 18 for operation. The server 12 communicates with the elements 17 and 18 by transmitting messages to the network modules 20 in order to manage scenes, zones, light states, and/or sensor states for each light source 23 and sensor 27 based on lighting configuration data 41, discussed in more detail hereafter. Note that each of the server 12 and the gateway 14 forms a separately addressable node of the wireless network 19.

In general, there are at least two types of messages communicated by the network 19, unicast messages and multicast messages. A "unicast" message refers to a message that is destined for a specific node (e.g., element 17 or 18), referred to as the "destination" or "destination node." Such a message includes a destination address identifying the destination node. In general, a node in the network 19 does not respond to a unicast message unless the node is identified by either the destination address or a hop address in the message. Thus, if a node is not the destination node for a unicast message or within the data path for routing the message to its destination, the node does not respond to the unicast message but rather discards it upon reception.

In one exemplary embodiment, reliability of data communication is enhanced through the use of acknowledgements. That is, when a node ("receiving node") receives a unicast message transmitted from another node ("transmitting node"), the receiving node replies with an acknowledgment to the transmitting node. Thus, upon receipt of the acknowledgement, the transmitting node is aware that the unicast message has been received by the receiving node. If the transmitting node does not receive an acknowledgment within a predefined time period after transmission, then the transmitting node assumes that the unicast message failed to reach the receiving node and retransmits the unicast message. Note that each message includes the address of the transmitting node. In addition, an acknowledgement is sent for each respective hop along a data path. Thus, each node along the data path is able to ensure that the next hop has received the unicast message.

A "multicast" message, on the other hand, is a message destined for multiple nodes. In many cases, it is intended for a multicast message to be received and processed by every node in the network 19. Such multicast messages are sometimes referred to as "broadcasts." Multicast messages are not communicated along predefined data paths indicated by the routing tables of the network nodes, and acknowledgments are usually not returned for multicast messages. Instead, a multicast message is generally retransmitted by nodes that receive it regardless of whether such nodes are identified by the message.

In one exemplary embodiment, each multicast message includes a value, referred to as a "time-to-live (TTL) value," indicating the number of times that the message is to be retransmitted. Each node that receives a multicast message is configured to retransmit the message as long as its TTL value is above a threshold, such as zero. However, before retransmitting the multicast message, the node decrements the TTL value. Thus, eventually, a node receives the multicast message after the TTL value has reached the threshold and, therefore, does not retransmit the message. Accordingly, depending on the TTL value, a multicast message is retransmitted through the network 19 for a limited time.

Note that the same multicast message may be received by multiple nodes and retransmitted by each such node. Thus, alter transmission of a multicast message, the message is repeatedly transmitted by other nodes through the network 19 for a finite period of time. In one exemplary embodiment, acknowledgments are not communicated for multicast messages, although the communication of acknowledgments is possible, if desired. Instead, it is assumed that each node of the network 19 has received the multicast message. However, in actuality, a given node may have missed the message due to a data collision or some other reason. Hence, multicast messaging is generally considered less reliable than unicast messaging, and unicast messaging is often used for critical messages where a guaranteed reception of a message by its destination is needed or desired. However, as noted above, it is possible to use acknowledgements in order to increase the reliability of multicast messages.

The traffic of the network 19 communicated by the gateway 14 and server 12 across the network 15 are encapsulated into data packets that are compatible with the network 15. As an example, when the network 15 comprises the Internet, network traffic may be encapsulated via transmission control protocol/Internet protocol (TCP/IP). In such an example, if the gateway 14 receives a multicast message or a unicast message destined for the server 12, then the gateway 14 encapsulates the message into one or more IP data packets and transmits the IP data packets via the network 15 to the server 12. The server 12 deencapsulates such packets to recover the message originally encapsulated by the gateway 14. When the server 12 transmits a multicast message or a unicast message destined for any of the elements 17 or 18, the server 12 encapsulates the message into one or more IP data packets and transmits the IP data packets via the network 15 to the gateway 14. The gateway 14 deencapsulates such packets to recover the message originally encapsulated by the server 12. If the message is multicast, the gateway 12 retransmits the message (after decrementing the message's TTL value) for reception by the elements 17 and 18. If the message is a unicast message, the gateway 14 finds the next hop for the message and transmits the unicast message to the next hop so that the message will eventually arrive at its destination.

The server 12 is further configured to communicate with a communication device 33 via the network 15. A user may utilize the communication device 33, such as, for example, a cellular telephone, a tablet, a laptop computer or a desktop computer, in order to communicate with the server 12 for controlling and/or configuring the system 10. In this regard, the user may utilize the device 33 to access a web browser (not shown in FIG. 1) in order to communicate with the server 12 via the network 15 and to define and/or update the lighting configuration data 41. The server 12 then broadcasts the data 41 via multicast messages of the wireless network 19, as will be described in more detail hereafter.

In the embodiment shown by FIG. 1, the communication device 33 communicates with the server 12 via the network 15 without communicating through the wireless network 19. However, it is possible for the communication device 33 to access the network 15 and, hence, the server 12 through the wireless network 19 and gateway 14, if desired. Further, in one exemplary embodiment, the communication device 33 is a mobile device, such as a cellular telephone, tablet, or lap-top computer, and the device 33 is used to facilitate configuration of the system 10, as will be described in more detail hereafter. However, it is possible for the communication device 33 to be stationary (e.g., a desktop computer) in other embodiments.

As shown by FIG. 1, the system 10 further comprises a wireless communication device 34 that is configured to transmit a wireless signal, referred to hereafter as "proximity signal," for reception by the network modules 20. In one embodiment, the proximity signal is used during a commissioning process in order to detect nearby elements 17 and 18 so that they can be associated with their proper identifiers. In this regard, a user takes the communication device 33 into the environment in which the light sources 23 and sensors 27 are located and accesses map data (not shown in FIG. 1), discussed in more detail hereafter, within the server 12 via the web browser, such as, for example, a graphical user interface (GUI), in order to display on the device 33 a map of the such environment. The user also takes the wireless communication device 34 into the same environment, such as a room of a building, and the device 34 wirelessly transmits the proximity signal, which is received by a limited number of network modules that are within range of the device 34. In one embodiment, the user activates a user interface (e.g., presses a button) of the device 34 to trigger the device 34 to transmit the proximity signal, but other methods for initiating the proximity signal are possible in other embodiments. Further, it is also possible for the device 34 to be configured to continuously transmit the proximity signal. In one embodiment, the proximity signal is a wireless radio frequency (RF) signal, but the proximity signal may have other frequency ranges in other embodiments.

Each module 20 within range of the proximity signal measures the signal strength of the received signal and provides to its respective controller 21 a value, referred to herein as received signal strength indicator (RSSI), that is indicative of the measured signal strength. The RSSI generally indicates the distance of the wireless communication device 34 from the network module 20 that received the proximity signal. In this regard, the proximity signal is attenuated as it propagates such that a higher received signal strength generally indicates that the wireless communication device 34 is closer to the receiving network module 20, though the RSSI may also be impacted by objects (e.g., walls) that are between the device 34 and the receiving module 20. In one embodiment, it is assumed that a greater RSSI indicates that the measured signal strength is higher and the wireless communication device 34 is, therefore, likely closer to the network module 20.

Once a network module 20 of an element 17 or 18 has received the proximity signal and provided the RSSI to the controller 21, the controller 21 is configured to compare the RSSI to a predefined threshold. If the RSSI exceeds the threshold indicating that the wireless communication device 34 is in relative close proximity to the element 17 or 18, the controller 21 broadcasts the RSSI via a multicast message that is received by the server 12. Such multicast message includes the RSSI and the network address of the element 17 or 18 from which the message originated. Thus, the server 12 is aware of which elements 17 and/or 18 are currently in close proximity to the wireless communication device 34. For example, if the user with the wireless communication device 34 enters a room, the predefined threshold is preferably established such that the RSSIs for the lighting elements 17 in the same room likely exceed the threshold. Thus, these elements 17 report their respective RSSI to the server 12. The RSSIs for the lighting elements 17 in other rooms are likely below the threshold due their distance from the device 34 or objects (e.g., walls) between the device 34 and such lighting elements 17. Therefore, these lighting elements 17 in other rooms refrain from reporting their respective RSSIs to the server 12. Accordingly, based on the reported RSSIs, the server 12 is aware of which lighting elements 17 are likely in the same room as the user. In one embodiment, the server 12 communicates with the communication device 33 based on the reported RSSIs in order to discover aspects pertaining to the topology of the network 19, as will be described in more detail hereafter.

Figure 2:
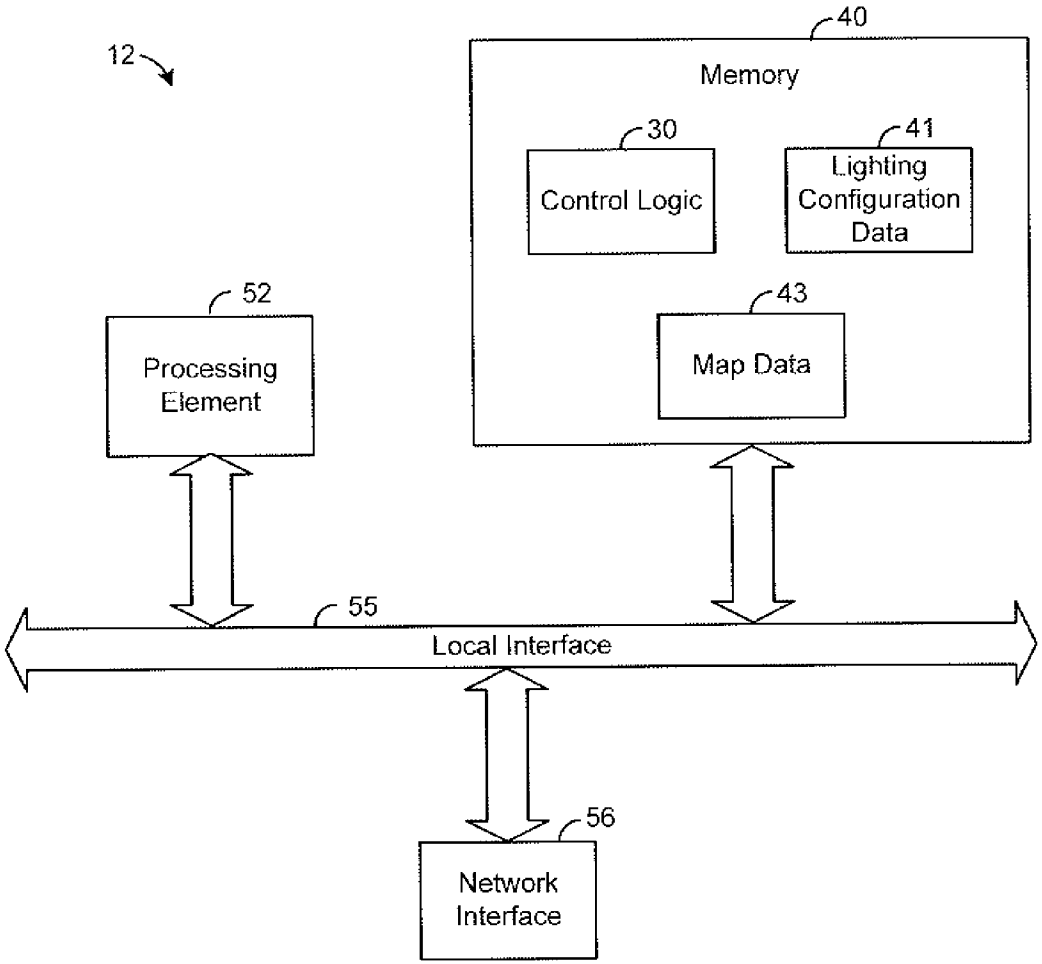
FIG. 2 is a block diagram illustrating an exemplary embodiment of a server, such as is depicted by FIG. 1.

FIG. 2 depicts an exemplary embodiment of the server 12 of FIG. 1. In the embodiment depicted by FIG. 2, the control logic 30 is implemented in software and stored in memory 40 of the server 12. In other embodiments, the control logic 30 may be implemented in hardware, software, firmware, or any combination thereof.

The server 12 further comprises lighting configuration data 41 and map data 43 stored in the memory 30. The control logic 30 is configured to manage the lighting configuration data 41 and the map data 43 and to transmit messages indicative of the data 41 and 43 via the network 15 (FIG. 1), as will be discussed in more detail hereafter. The lighting configuration data 41 indicates one or more parameters for each lighting element 17 (FIG. 1) and each sensor element 18 (FIG. 1) in the system 10 (FIG. 1). In this regard, each lighting element 17 and sensor element 18 is identified in the data 41 by the element's respective network identifier for the network 19. For each lighting element 17, the data 41 identifies the number of light sources 23 and indicates an identifier for each light source 23, and the data 41 maps each lighting element 17 and sensor element 18 to various scenes, zones, and/or light states. Note that if each element 17 is limited to a single light source 23 or a single light identifier, then the network identifier may be used as the light identifier. In addition if each element 18 is limited to a single sensor 27 or single sensor identifier, then the network identifier may be used as the sensor identifier.

A zone generally refers to a logical collection of light sources 23. For example, it may desirable to have each of a plurality of light sources 23 activated or otherwise controlled in a certain way in response to a detection by a sensor 27 of a given sensor element 18 or other event, such as a user input received from the communication device 33 or other device. In such an example, a zone may be defined that includes each of the foregoing light sources 23 as members of the zone, and such zone may be assigned a unique zone identifier. In the lighting configuration data 41, the zone identifier is correlated with the light identifiers of each of the light sources 23 that is a member of the identified zone. Thus, the data 41 can be accessed using the zone identifier as a key to determine which light sources 23 are members of the identified zone, thereby allowing the light sources 23 to be controlled on a per-zone basis. As an example, when a sensor 27 detects an event for which the state of a given zone is to change in response to the event, a message indicative of the event may be transmitted through the network 19, and the light sources 23 that are members of such zone may be controlled in response to the command based on their membership in the zone, as indicated by the data 41.

A scene generally refers to a predefined set of light states for at least one light source 23. Note that a light state generally refers to a brightness level for a given light or any other state controlled by the light's controller 21. In one embodiment, a light state is associated with a brightness value that ranges from a minimum to a maximum. The controller 21 is configured to provide a control signal to the light driver 22 for controlling the power delivered to the light source 23 based on the light's brightness value for a desired lighting state. At the minimum brightness value, the light driver 22 provides minimum or no power such that the light source 23 is deactivated (e.g., turned off) such that it does not emit light. At the maximum brightness value, the light driver 22 provides a maximum amount of power such that the light's brightness is at its highest level. For values between the minimum and maximum, the light source 23 is dimmed proportionally to its brightness value. For example, a higher voltage may be provided for higher brightness values such that the brightness of light emitted by the light source 23 increases as the brightness value increases up to the maximum brightness value. Note that any light source 23 may be a member of any number of zones.

A scene can be associated with any number of lighting elements 17 and/or light sources 23, and a scene is associated with a triggering event, such as a detection by a sensor 27 of a given sensor element 20. Further, each scene is assigned a unique scene identifier and specifies a certain light state for each light source 23 associated with the scene. As an example, for a particular scene, assume that the brightness value of the light source 23 of a lighting element 17 associated with the scene is midway between the minimum brightness value and the maximum brightness value (e.g., at 50% brightness). When such a scene is to occur, such as in response to a detection of an event by a sensor 27, the controller 21 of the associated lighting element 21 provides a control signal (based on the brightness value defined for the scene) such that the light driver 22 provides a current to dim the light source 23 to a 50% brightness level (i.e., half of the brightness of the light in its fully activated state). Note that any lighting element 17 may be associated with any number of scenes. Further, a scene may be associated with a zone. For example, for a given scene, a scene may specify that the light sources 23 within an identified zone are to be controlled in a certain way (e.g., deactivated, fully activated, or dimmed to a specified brightness value).

Moreover, the lighting configuration data 41 indicates all of the zones and scenes of the system 10. For example, for each scene, the data 41 may correlate the scene's identifier with the network identifiers of all of the lighting elements 17 impacted by the scene, the light identifiers of light sources 23 impacted by the scene, and/or the zone identifiers of all of the zones impacted by the scene. Further, for each light source 23 impacted by the scene, the data 41 correlates a light state (e.g., brightness value) with the scene identifier. Thus, the data 41 can be analyzed to determine how each lighting element 17 associated with a given scene is to control its light source 23 or light sources 23 when the scene occurs.

As will be described in more detail below, the lighting configuration data 41 is preferably pushed to the elements 17 and 18 in a selective manner such that each element 17 and 18 is capable of operating according to the configuration data 41. For example, the information in the lighting configuration data 41 affecting a given lighting element 17 is preferably transmitted from the server 12 to such lighting element 17, which locally stores such data 41.

As a mere example, if the lighting element 17 is a member of a particular zone, then the zone identifier of such zone is pushed to and stored by the lighting element 17. Accordingly, the lighting element 17 is aware of which zones it is a member, and when the lighting element 17 receives a message (e.g., a command) pertaining to the zone, the lighting element 17 receives and processes the message (e.g., performs the commanded action). If the lighting element 17 receives a message pertaining to a zone for which it is not a member, then the lighting element 17 can ignore the message, except that the lighting element 17 may retransmit the message depending on the message type so that the message can reach other elements 17 and 18 of the network 19.

If the lighting element 17 is associated with a particular scene, then the scene identifier of such scene is similarly pushed to and stored by the lighting element 17. Also, information indicative of the state of the element's light source 23 or light sources 23 for such scene, such as a brightness value, is also pushed to and stored by the lighting element 17. Thus, the lighting element 17 is aware of which scenes with which it is associated and how to control its light source 23 or light sources 23 for such scenes. Accordingly, if the lighting element 17 receives a message indicating that a particular scene is to be implemented, then the lighting element 17 is configured to control its light source 23 or light sources 23 accordingly to implement the identified scene. Note that is it unnecessary for any lighting element 17 to be aware of the zones, scenes, and light states that are associated with or otherwise pertain to other lighting elements 17.

Also note that it is possible for the lighting configuration data 41 to be transmitted to the elements 17 and 18 via unicast messages. Such a technique facilitates the downloading of configuration data 41 since the server 12 can separately address each element 17 or 18 and transmit to such element 17 or 18 only the configuration data 41 that pertains to it. However, such an approach also significantly increases network traffic. In this regard, for the server 12 to communicate the configuration data 41 in such manner, a route to each element 17 and 18 affected by the configuration data 41 would need to be learned, resulting in the generation of numerous route discovery messages. Such messaging scheme would significantly increase network traffic (as well as possibly creating contention and data collision issues, resulting in retransmissions and acknowledgements that further increase network traffic). Indeed, it could take considerable time for the server 12 to successfully learn routes to the elements 17 and 18 and to then push the configuration data 41 to the elements 17 and 18 as desired, particularly for large systems having numerous elements 17 and 18.

To alleviate some of the foregoing issues, the server 12 is configured to broadcast slices of the lighting configuration data 41 via multicast messages rather than using unicast messages. Accordingly, the lighting configuration data 41 is downloaded, as appropriate, from the server 12 to the elements 17 and 18 without having to learn routes to the elements 17 and 18 and, hence, incur the additional messaging that is associated with unicast messages and the learning of routes for unicast messages. Thus, the overall time required to push the configuration data 41 to the elements 17 and 18 is significantly decreased.

Preferably, the lighting configuration data 41 is organized and communicated in a hierarchical scheme in order to facilitate broadcasting of the data 41 to the elements 17 and 18. In one embodiment, the server 12 communicates the lighting configuration data 41 in a three stage process, referred to hereafter as the "element configuration process."

In this regard, in a first stage, the server 12 communicates multicast messages that correlate network identifiers of the elements 17 and 18 with light identifiers and sensor identifiers, as will be described in more detail hereafter. Based on such messages, each controller 21 learns the light identifiers and/or sensor identifiers that are connected to and operate under the control of the controller 21.

After the first stage, the server 12 communicates in a second stage multicast messages that correlate the light identifiers with the scene identifiers and zone identifiers, as will be described in more detail hereafter. Based on such messages, each controller 21 learns the scenes and zones associated with the light source 23 or light sources 23 that are under its control (e.g., the light source 23 or light sources 23 of the same lighting element 17). The server 12 also communicates multicast messages that correlate light states with the scene identifiers, the light identifiers, and the zone identifiers, as will be described in more detail hereafter. Based on such messages, the controller 21 of each lighting element 17 learns the light states for the light source 23 or light sources 23 under its control for each scene associated with such light source 23 or light sources 23.

After the second stage, the server 12 communicates in a third stage multicast messages with the elements 17 and 18 in order to ensure that each element 17 and 18 has received the messages that pertain to it (e.g., carrying data needed by the element 17 or 18 to operate appropriately). Once it is ensured that each element 17 and 18 has received all of the messages pertaining to it, the process of pushing lighting configuration data 41 from the server 12 to the elements 17 and 18 is complete, and normal operation of the system 10 may commence. That is, users may begin providing inputs via the sensors 27 in order to control the states of the light sources 23, including activating various predefined scenes, as may be desired.

Figure 3:
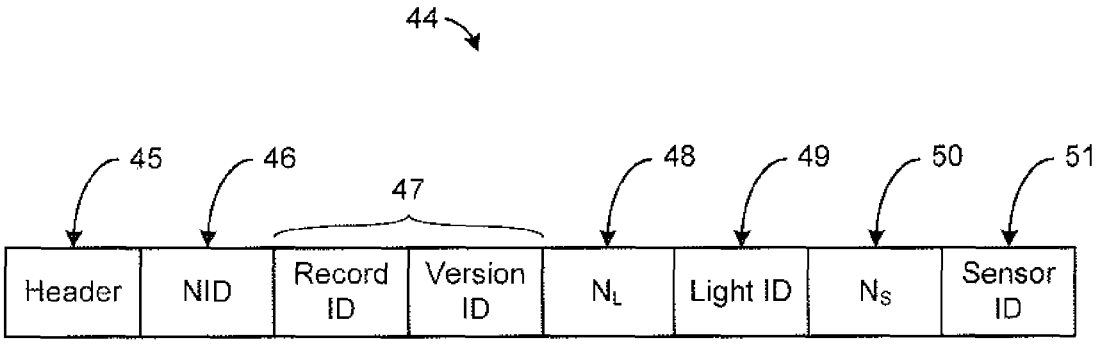
FIG. 3 depicts an exemplary embodiment of a message communicated in a first stage of an exemplary element configuration process.

Note that the messages of each stage respectively have a predefined format so that each controller 21 can parse and analyze the messages in order to understand the information that is contained in the messages. FIG. 3 depicts an exemplary multicast message 44 that associates a network identifier for a particular lighting element 17 with light identifiers of light sources 23 that are within the element 17 and controlled by the element's controller 21.

As shown by FIG. 3, the message 44 has a plurality of fields 45-51. A header 45 includes various overhead information that is used by the network 19 in communicating the message 44 through the network 19. The header field 45 may include various parameters, such as message type (e.g., indicating that the message is a multicast message for the first stage of the element configuration process) and a TTL value, which is decremented as the message propagates through the network 19, as described above. A network identifier (NID) field 46 indicates the network identifier of the element 17 to which the message 44 pertains. Note that, prior to the first stage of the element configuration process, each controller 21 of a given element 17 or 18 knows the element's respective network identifier but does not know any of the configuration data 41 at the server 12.

The message 44 also includes a slice identifier (ID) field 47 indicating a record identifier and a version identifier, which will be described in more detail hereafter. As will be described in more detail below, the version identifier is used to confirm whether the slice carried by the message 44 is obsolete.

The message 44 further includes a light number ($N_L$) field 48 indicating the number of lights and a sensor number ($N_S$) field indicating the number of sensors 27 of the element 17 or 18 identified by the NID field 46. A light identifier (ID) field 49 specifies the identifier of a light source 23, if any, of the identified element 17 or 18, and a sensor identifier field 51 specifies the identifier of a sensor 27, if any, of the identified element 17 or 18. Note that the number of light identifier fields 49 and the number of the sensor identifier fields 51 correspond to the numbers indicated by fields 48 and 50, respectively. As an example, if the field 48 indicates that there are two light sources 23 for the identified element 17 or 18, then it is expected that there will be two light identifier fields 49 following field 48.

The elements 17 and 18 receive and retransmit the message 44 such that it should propagate through the entire network 19, except that communication problems (e.g., data collisions) may prevent the message 44 from reaching one more elements 17 and 18. The elements 17 and 18 that are not identified by the NID field 46 simply retransmit it so that the message can reach other elements 17 and 18 that have yet to receive the message 44, according to the techniques described above for broadcasting messages through the network 19. When the element 17 or 18 identified by the NID field 46 receives the packet, the element 17 or 18 retains and stores the information of fields 47-51, thereby learning which light sources 23 and/or sensors 27, if any, are coupled to and operate under the control of its controller 21.

Thus, the element 17 or 18 knows the first level of its lighting configuration data 41 hierarchy. As will be described in more detail hereafter, the light and/or sensor identifiers learned in the first stage of the element configuration process for any given element 17 or 18 are used by such element 17 or 18 to determine which messages in a future stage pertain to it.

In the second stage of the element configuration process, each lighting element 17 learns which scenes and zones are associated with its respective light source 23 or light sources 23. In one exemplary embodiment, the format of messages in the second stage is similar to that in the first stage except that scene identifiers and/or zone identifiers are associated with light identifiers instead of light identifiers and/or sensor identifiers being associated with NIDs as is the case for the first stage. In this regard, FIG. 4 depicts an exemplary multicast message 52 for the second stage of the element configuration process.

Figure 4:
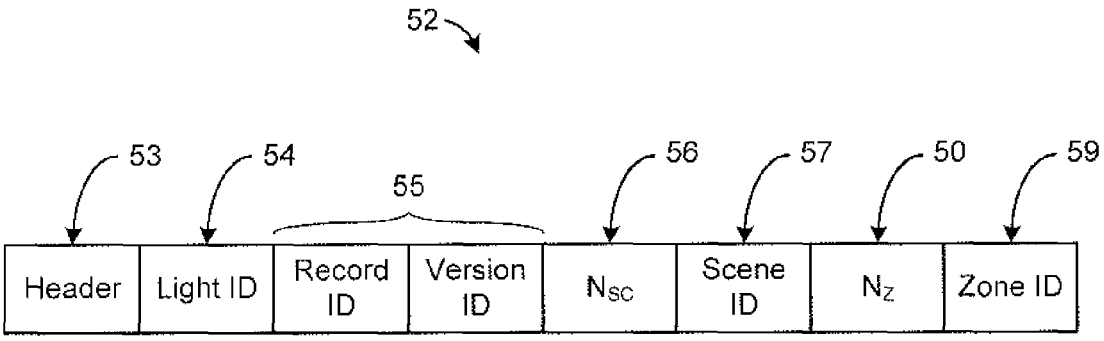
FIG. 4 depicts an exemplary embodiment of a message communicated in a second stage of an exemplary element configuration process.

As shown by FIG. 4, the message 52 has a plurality of fields 52-59. A header 53 includes various overhead information that is used by the network 19 in communicating the message 52 through the network 19, similar to the header 45 of the message 44 depicted by FIG. 3. A light identifier field 54 indicates the light identifier of the light source 23 to which the message 52 pertains. The message 52 also includes a slice ID field 55 having a record identifier and a version identifier, similar to the message 44. As will be described in more detail below, this version identifier is used to whether the slice carried by the message 52 is obsolete.

The message 52 further includes a scene number ($N_{SC}$) field 56 indicating the number of scenes associated with the identified light source 23 and a zone number ($N_Z$) field 58 indicating the number of zones associated with the identified light source 23 (i.e., the number of zones to which the identified light source 23 is a member). A scene identifier field 57 specifies the identifier of a scene, if any, that is associated with the identified light source 23, and a zone identifier field 51 specifies the identifier of a zone, if any, that is associated with the identified light source 23. Note that the number of scene identifier fields 57 and the number of the zone identifier fields 59 correspond to the numbers indicated by fields 56 and 58 respectively. As an example, if the field 56 indicates that there are two scenes associated with the identified light source 23, then it is expected that there will be two scene identifier fields 57 following field 56.

The elements 17 and 18 receive and retransmit the message 52 such that it should propagate through the entire network 19, except that communication problems (e.g., data collisions) may prevent the message 52 from reaching one more elements 17 and 18. The elements 17 and 18 that do not have a light source 23 identified by the light identifier field 54 simply retransmit the message 52 so that it can reach other elements 17 and 18 that have yet to receive the message 52, according to the techniques described above for broadcasting messages through the network 19. When the element 17 having a light source 23 identified by the light identifier field 54 receives the message 52, the element 17 stores the information of fields 55-59 and correlates such fields 55-59 with the identifier of the light source 23, thereby learning which scenes and zones are associated with the identified light source 23. Upon receiving such information for each light source 23 of a given element 17, the element 17 knows the second level of its lighting configuration data hierarchy.

In the second stage of the element configuration process, each lighting element 17 also learns the light states that are associated with the scenes that it is responsible for implementing. In this regard, the server 12 broadcasts messages that define the appropriate light states for scenes. In particular, a message in the second stage correlates scene identifiers, light identifiers, sensor identifiers, and light states so that each lighting element 17 can learn information about the scenes associated with it, such as what event triggers a given scene and the light state or states for its light source 23 or lights associated with the scene. Moreover, when an element 17 receives a message having a scene identifier associated with the element 17, the element 17 stores the contents of the message and correlates such contents with the appropriate scene identifier, thereby learning when to implement the scene and how to control its light source 23 or light sources 23 associated with the scene. Like the other message formats, the foregoing message is associated with a version identifier that can be used to confirm whether the slice carried by the message is obsolete.

As an example, assume that a particular lighting element 17 has a light source 23, referred to hereafter as "Light A," associated with a particular scene, referred to hereafter as "Scene A." Assume that scene A is to be triggered by activation of a sensor 27, referred to hereafter as "Sensor A," and that Light A is to be set to a particular brightness value, referred to hereafter as "Brightness A," during the scene. In such an example, a message transmitted by the server 12 during the second stage of the element configuration process preferably includes the identifier of Scene A and correlates such identifier with the identifier of Light A. The message also correlates the identifier of Scene A with the identifier of Sensor A indicating that activation of Sensor A triggers such scene. The message further correlates the identifier of Light A with Brightness A indicating that, during the scene, Light A is to be set to Brightness A. When the lighting element 17 of Light A receives the message, the controller 21 of such lighting element 17 recognizes that it is associated with the identified scene by comparing the scene identifier of the message with the scene identifiers associated with the lighting element 17 and obtained by the lighting element 17 in the second stage of the element configuration process. In response, the lighting element 17 stores the foregoing information from the message and correlates such information with the identifier of Scene A thereby learning when to trigger Scene A and how to control Light A during such scene.

Thereafter, during operation, when sensor A is activated, the sensor element 18 of such sensor 27 broadcasts a message indicating that Sensor A has been activated. When the foregoing lighting element 17 receives the message, its controller 21 compares the identifier of Sensor A to the sensor identifiers stored therein. During such analysis, the controller 21 determines that activation of Sensor A triggers Scene A. Thus, based on the data stored in the element 17 during the element configuration process, the controller 21 sets the brightness level of Light A according to Brightness A, thereby implementing Scene A in response to activation of Sensor A. Note that it is unnecessary for the sensor element 18 of Sensor A to be aware of what actions the other elements 17 or 18 perform in response to the trigger event (i.e., activation of Sensor A in the current example). Such sensor element 18 simply broadcasts a message indicating the occurrence of the event detected by Sensor A. The other elements 17 have been appropriately configured during the element configuration process to perform the actions that are associated with the detected event.

In addition, it should be noted that it is unnecessary for a scene identifier to be used to control any of the light sources 23 in response to a given event. In this regard, it is possible for a message in the second stage to correlate a particular light identifier with a particular sensor identifier without associating such identifiers with a scene identifier. In such case, activation of the identified sensor 27 affects the operation of the identified light source 23. As an example, it may be desirable to associate a particular light source 23 with a particular sensor 27 such that activation of the sensor 27 causes the light source 23 to change to a particular state, such as to a fully activated state. In such example, a message transmitted in the second stage may simply associate the identifier of the light source 23 with the identifier of the sensor 27 and the appropriate brightness value without associating the identifier of the light source 23 with a scene identifier. In such example, the element 17 of the identified light source 23 recognizes that the message pertains to it based on the light identifier in the message and, thus, stores information of the message associated with such light identifier. In other examples, other variations of indicating how a particular light source 23 is to be controlled in response to a particular sensor event are possible.

Once the configuration data 41 has been pushed to the elements 17 and 18, it is possible for an update to the data 41 to occur. As an example, a user of the communication device 33 may access the configuration data 41 and add, delete, or modify a scene. Such updates may be broadcast by the server 12 according to the same techniques described above for the element configuration process. If the update is an addition, then it may not be necessary to overwrite or delete configuration information previously stored by the elements 17 and 18. As an example, if a new scene is added, configuration information for the new scene can be broadcast and stored, as described above, without changing the configuration information previously stored in the elements 17 and 18. For other updates, however, the elements 17 and/or 18 may be configured to delete or overwrite configuration information previously stored by the elements 17 and/or 18. As an example, assume that a given lighting element 17 receives a message defining a light state for a particular light source 23 during a particular scene. Further assume that the lighting element 17 has previously stored configuration information indicating a light state for the same light source 23 during the same scene. In such a case, the controller 21 of the lighting element 17 may be configured to overwrite such previous configuration information with the new configuration information since the new information is in conflict with the previous information.

Referring again to FIG. 2, in the third stage of the element configuration process, the server 12 is configured to ensure that each element 17 and 18 has received each message pertaining to it for the first two stages. In one embodiment, such verification is performed using the version identifiers that have been transmitted with the configuration information. In this regard, each separate message communicated in a given stage essentially represents a portion or "slice" of the configuration data 41. As an example, for the message 44 depicted by FIG. 3, the fields 48-51 represent a slice of the configuration data 41 that is uniquely identified by the record identifier and the version identifier of fields 46 and 47 respectively.

Each slice is uniquely identified by an identifier, referred to herein as a "slice identifier," that includes a record identifier and a version identifier. The record identifier identifies the slice from other slices that are stored in the data 41. As an example, each slice may be stored in a respective entry of a database along with its record identifier, which is unique to and identifies the slice that is stored in the same entry. The version identifier for the slice may also be stored in the same entry and is changed (e.g., incremented) each time the slice is updated. Thus, the version identifier identifies one version of its correlated slice from another version of the same slice. For example, if a light source 23 is added to an element 17 identified by the network identifier in field 46, then the slice of the configuration data 41 transmitted by the message 44 may be updated to include a new light identifier. Further, the version identifier associated with the slice is updated to distinguish the new version of the slice (with the additional light identifier) from the previous version of the slice (without the additional light identifier).

After the second stage of the element configuration process, the server 12 is configured to broadcast a multicast message, referred to hereafter as a "multicast ping." As will be described in more detail hereafter, each element 17 and 18 that receives the multicast ping transmits a reply message for reception by the server 12. The reply message could be a unicast message. However, to avoid having to learn routes between the server 12 and elements 17 and 18, the reply is preferably a multicast message.

The multicast ping includes the slice identifier of each slice of the configuration data 41 transmitted during the first two stages of the element configuration process. As indicated above, each slice identifier includes a record identifier and a version identifier. Each element 17 and 18 is configured to analyze the slice identifiers of the multicast ping in an effort to determine whether it has missed any messages of the first two stages and to then indicate in the reply which messages, if any, it missed so that the control logic 30 of the server 12 is aware of which messages to retransmit. There are various techniques that can be used to determine whether any given message has been missed. A few exemplary techniques will now be described in more detail below.

In the regard, the controller 21 of each element 17 and 18 is configured to compare the slice identifiers of slices that it retained and stored during the first two stages. For each such slice, the controller 21 compares the version identifier of the stored slice identifier to the version identifier in the multicast ping that is correlated with the same record identifier. If the version identifiers do not match, then the controller 21 is aware that the stored slice identified by such record identifier is obsolete. That is, an updated version of the slice exists but has yet to be received by the controller 21. In such case, the controller includes such record identifier in the reply to the multicast ping. In response to the reply, the control logic 30 of the server 12 is configured to retransmit the message having the slice identified by record identifier in the reply.

As described above, the controller 21 of each element 17 and 18 determines which slices it is interested in based on messages from the server 12. In particular, through the hierarchical messaging scheme described above, the controller 21 of a given element 17 learns which light identifiers, sensor identifiers, scene identifiers, and zone identifiers pertain to it. When a message is received that includes an identifier of interest, the controller 21 retains and stores the slice carried by the message. If the controller 21 is looking for a message pertaining to a particular identifier but does not receive such message, then the controller 21 is aware that such message has been missed. As an example, if a controller 21 has determined that it is to implement a particular scene having a particular scene identifier but does not receive a message defining the light state or states for such scene, then the controller 21 is aware that it has missed a message that indicates the light states for the scene. In response, the controller 21 may include such scene identifier in the reply and to correlate such identifier with the light identifier of its respective light source 23. Based on the reply, the control logic 30 is configured to retransmit the message that has the slice defining the state or states correlated with the same light identifier and scene identifier.

In one exemplary embodiment, the controller 21 of each element 17 and 18 is configured to store the slice identifiers of each message it receives, including the messages that do not pertain to it. By comparing the list of slice identifiers from received message to the slice identifiers in the multicast pint, the controller 21 can determine the record identifiers of the messages that were missed by it. In such case, the controller 21 includes the record identifiers of the missed messages in the reply, and the control logic 30 is configured to retransmit the slices of the missed messages in response. In other embodiments, yet other techniques for identifying missed slices are possible.

If a controller 21 of a given element 17 or 18 determines that it has not missed any slices, the controller 21 is configured to include in the reply to the server's multicast ping the highest version identifier received by the controller 21 in the messaging of the first two stages. The control logic 30 is configured to compare such version identifier to the highest version identifier of any slice in the data 41. If the two version identifiers match, then the control logic 30 assumes that the element 17 or 18 from which the reply was received has received all slices pertaining to it. Such slices will be retransmitted from that point until the end of the third stage only to the extent that they are identified as missing by another element 17 or 18 or are updated. If the compared version identifiers do not match, then the control logic 30 is configured to retransmit slices of the data 41 having version identifiers greater than one returned by the element 17 or 18.

Accordingly, during the third stage, the server 12 receives replies to its multicast pings, and such replies indicate which slices have been missed by at least one element 17 and 18. For any missed slice, the server 12 is configured to retransmit the missed slice in a new multicast message. In this regard, after receiving the replies in the third stage, the server 12 essentially repeats the first two stage but does so only with messages having slices missed by at least one element 17 and 18. Accordingly, the elements 17 and 18 that missed a given slice when it was originally transmitted may receive the slice during the third stage. Note that for replies to the same multicast ping, the server 12 can be configured to transmit the same slice only once even if it was missed by multiple elements 17 and 18, thereby preventing potentially needless retransmissions of the same slice. After retransmitting the missed messages in the third stage, the server 12 again broadcasts a multicast ping, which includes the slice identifiers of all of the retransmitted slices since the last multicast ping. Such multicast ping prompts the elements 17 and 18 for replies reporting messages that still have not been received by at least one element 17 and 18. Such cycle of retransmitting messages and then reporting missing messages is repeated until each element 17 or 18 has received each slice that it needs for operation.

Note too that there is no guarantee that a multicast reply transmitted by any element 17 or 18 in response to a multicast ping will actually reach the server 12. In this regard, for multicast messages, there might not be an acknowledgement procedure like there is for unicast messages. However, missing of a reply by the server 12 should not cause any errors. In particular, if the server 12 fails to receive a reply to a multicast ping from a particular element 17 or 18 within a certain time period after transmitting the multicast ping, then the server 12 is configured to assume that the element 17 or 18 did not receive any of the slices that pertain to it provided that the server 12 has not previously confirmed that the element 17 or 18 has received all slices pertaining to it. Thus, in the absence of such confirmation, the server 12 retransmits all of the slices pertaining to that element 17 or 18.

The server 12 further comprises map data 43 stored in the memory 40. In one embodiment, the map data 43 indicates a layout of an environment, such as, for example, a floor plan of a building showing all of the rooms in the building. The server 12 may transmit the map data 43 to the communication device 33 (FIG. 1) in order to allow a user to view the layout of the environment during the commissioning process, as set forth above. As will be described in more detail hereafter, graphical icons respectively representing the light sources 23 and sensors 27 of the system 10 are inserted into a map defined by the map data 43. The user provides input for appropriately positioning each icon within the map according to the actual position within the environment of the corresponding light source 23 or sensor 27 represented by the icon. Data indicative of the icon positions within the displayed environment is then used in order to facilitate configuration of the system 10, as will be described in more detail hereafter.

The exemplary embodiment of the server 12 depicted by FIG. 2 further comprises at least one conventional processing element 52, such as a digital signal processor (DSP) or a central processing unit (CPU), that communicates to and drives the other elements within the server 12 via a local interface 55, which can include at least one bus. Furthermore, network interface 56 can transmit and receive data via the network 15 (FIG. 1). Thus, the user may utilize the communication device 33 to communicate with the server 15 via the network interface 56 in order to manually update the lighting configuration data 41 or the map data 43 as desired. The server 12 also transmits the messages to the controllers 21 of the lighting elements 17 and the sensor elements 18 via the network interface 56.

Figure 5:
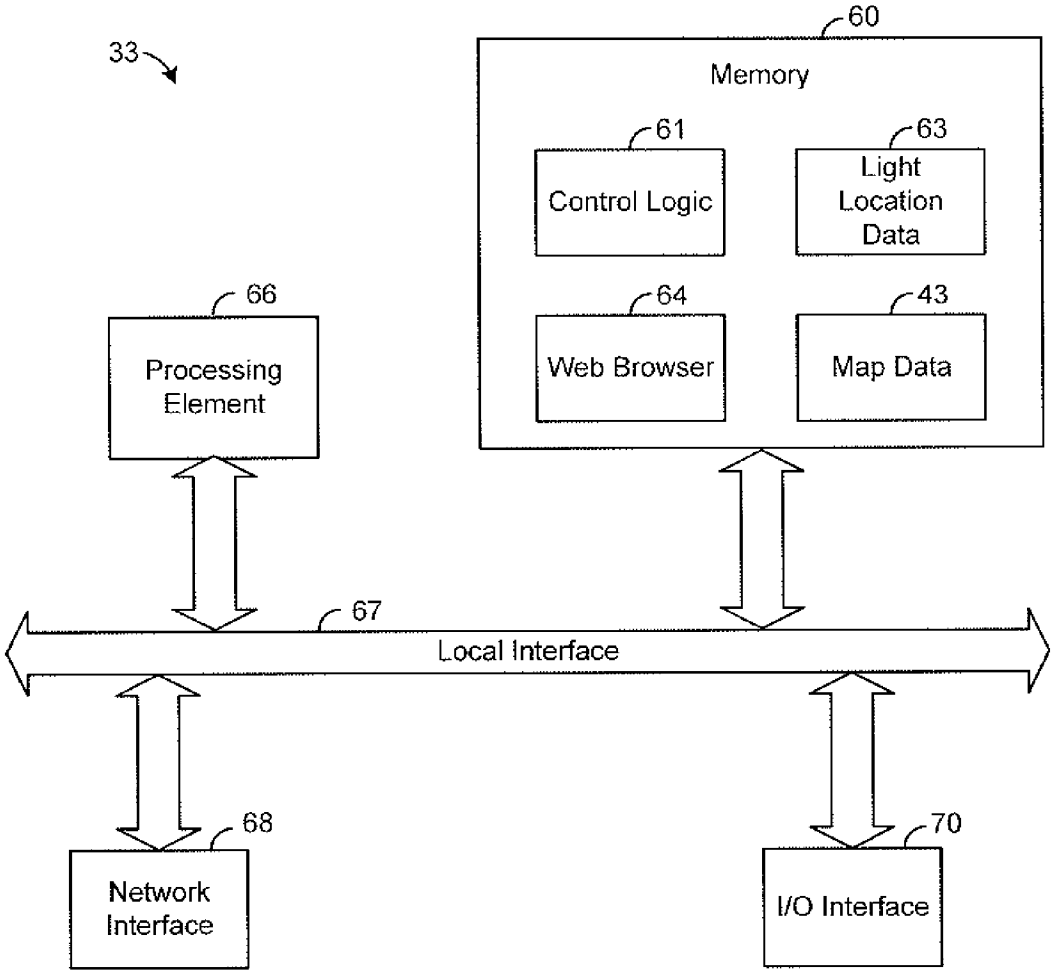
FIG. 5 is a block diagram illustrating an exemplary embodiment of a communication device, such as is depicted by FIG. 1.

FIG. 5 depicts an exemplary embodiment of the communication device 33 of FIG. 1. The communication device 33 comprises control logic 61, light location data 63, a web browser 64, and map data 43, which may be downloaded from the server 12. In one embodiment, the light location data 63 and the map data 43 are stored in memory 60 of the communication device 33. The light location data 63 indicates the location (relative to the map data 43) of each light source 23 (FIG. 1) and sensor 27 (FIG. 1) based upon the commissioning process used to configure the lighting control system 10 (FIG. 1), discussed in more detail hereafter. The map data 43 indicates the layout of the environment, such as, for example, a floor plan of a building in which the system 10 is installed. The device 33 receives the map data 43 from the server 12 via the network 15 and displays the map data 43 to a user via the web browser 64, such as, for example, a graphical user interface (GUI).

It should be noted that the control logic 61 can be implemented in software, hardware, firmware or any combination thereof. In an exemplary embodiment illustrated in FIG. 5, the control logic 61 is implemented in software and stored in memory 60 of the communication device 33.

The exemplary embodiment of the communication device 33 depicted by FIG. 5 further comprises at least one conventional processing element 66, such as a DSP or a CPU, that communicates to and drives the other elements within the device 33 via a local interface 67, which can include at least one bus. Furthermore, network interface 68 can transmit and receive data via the network 15. The device 33 further comprises an input/output (I/O) interface 70, such as, for example, a touch screen of a smart phone or tablet, or a mouse, keyboard, and monitor of a laptop or desktop computer, for allowing the user to input data into the device 33 and receive data from the device 33. In this regard, the user may access the lighting configuration data 41 (FIG. 2) via the web browser 64 of the device 33 in order to define and/or update the data 41, and the data 41 may then be transmitted to the modules 20 via broadcasting from the server 12, as set forth above. Furthermore, the user may upload the map data 43 via the device 33 or otherwise.

Figure 6:
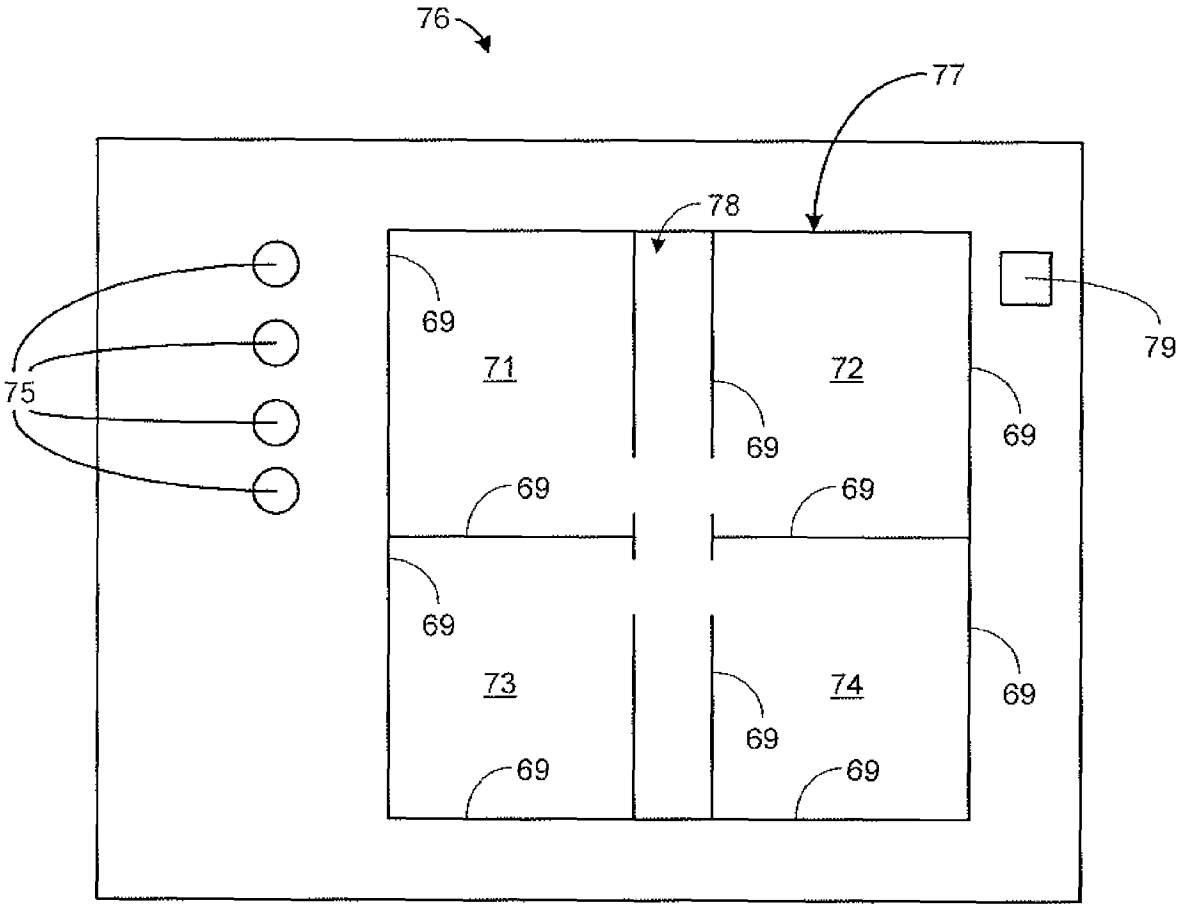
FIG. 6 depicts an exemplary graphical user interface (GUI) displaying a map of a building.

Referring now to FIG. 6, during the commissioning process, a user may take the wireless communication device 34 (FIG. 1) into the environment in order to facilitate association of each light source 23 with its appropriate light identifier and possibly position in the environment. In this regard, the user accesses the map data 43 of the server 12 via the device 33 in order to download a map of the environment, and the map is displayed to the user on the I/O interface 70 via the web browser 64. Assume that the environment comprises a building having a plurality of rooms 71-74, which are displayed on the device 33. In this regard, the lines 69 shown in FIG. 6 represents walls that divide the rooms 71-74 from one another and from a hallway 78 that separates rooms 71 and 73 from rooms 72 and 74.

In operation, assume that the user enters a room 71 and activates the device 34 such that it transmits the proximity signal, as described above. In one embodiment, the user activates the device 34 via a user interface (e.g., button or switch) of the device 34, but other techniques for activating the device 34 are possible in other embodiments.

Upon activation, the device 34 transmits the proximity signal, which is received by the network modules 20 within range of the device 34. As described above, each such module 20 provides an RSSI indicator indicative of a received signal strength, and the controller 21 of each element 17 and 18 having an RSSI above a predefined threshold transmits a message to the server 12 indicating such RSSI. Accordingly, the server 12 is aware of which light sources 23 and/or sensors 27 are in close proximity (e.g., in the same room) to the device 34 and, hence, the user.

The server 12 then transmits to the device 33 data defining icons 75 representing the light sources 23 that are determined to be in close proximity to the device 34, and such icons 75 are displayed by the device 33 via a GUI 76, as shown by FIG. 6. Note that such transmitted data includes the light identifiers and/or sensor identifiers of the light sources 23 and/or sensors 27 determined to be in close proximity to the device 34. In addition, the initial positions of the icons 75 within the displayed map do not need to correspond to the actual positions of the light sources 23 represented by such icons 75. In the example shown by FIG. 6, there are four light sources 23 determined to be in close proximity to the device 33 and, thus, there are four icons 75 representing such light sources 23. In other embodiments, other numbers of light sources 23 may be determined to be close proximity to the device 34.

In one embodiment, the initial positions of the icons 75 within the GUI 76 are based on the RSSIs of the lighting elements 17 having the light sources 23 represented by the icons 75. As an example, the icons 75 may be ranked from highest to lowest based on RSSI. In this regard, the icon 75 representing the light source 23 associated with the highest RSSI may be displayed above the other icons 75. Further, the other icons 75 may be displayed in descending order such that the icon 75 representing the light source 23 associated with the lowest RSSI may be displayed below the other icons 75. Accordingly, based on the positioning of the icons 75, it is possible for a user to determine which icons 75 likely represent which light sources 23 in the room. For example, based on the positioning of the icons 75, a user can determine which icon 75 likely represents the light source 23 to which he or she is the closest.

In order to map each icon 75 to its corresponding light source 23, the user may access each icon 75 via the I/O interface 70 in order to change the state of the light source 23. In one embodiment, the I/O interface 70 comprises a touch screen, and the user may select an icon 75 by touching the screen at the location of the icon 75. In response to selection of the icon 75, the state of the light source 23 represented by the icon 75 is changed so that the user can discern with certainty which light source 23 corresponds to the selected icon 75 by observing the light sources 23 in the room. For example, if the corresponding light source 23 is off (i.e., not emitting light), the light source 23 may be activated such that it emits light. If the corresponding light source 23 is on (i.e., emitting light), the light source 23 may be deactivated such that it stops emitting light. Each time the same icon 75 is selected, the state of the corresponding light source 23 is changed from its current state to a different state. Thus, the user may select the same icon 75 over and over, thereby changing the state of the corresponding light source 23 over and over, until the user is satisfied that he or she has found the light source 23 corresponding to the icon 75 being selected.

Note that there are various techniques that could be used to control the light sources 23 based on user selections of the icons 75, as described above. In one exemplary embodiment, the data defining a given icon 75 received from the server 12 indicates the light identifier of the light source 23 that corresponds to such icon 75. When a user has selected a particular icon 75, the communication device 33 retrieves the light identifier for the selected icon 75 and transmits to the server 12 via the network 15 a message requesting that the state of the light source 23 identified by the retrieved light identifier be changed. In response, the control logic 30 of the server 12, based on the light identifier received from the device 33, transmits a command to the lighting element 17 that controls the identified light source 23. Such a command may be a unicast message or a multicast message, and the command instructs the lighting element 17 to change the state of the light source 23 that corresponds to the icon 75 selected by the user. In response, the controller 21 of such lighting element 17 changes the state of the light source 23 (e.g., turns the light source 23 on or off depending on the light's current state) so that the state is changed.

Figure 7:
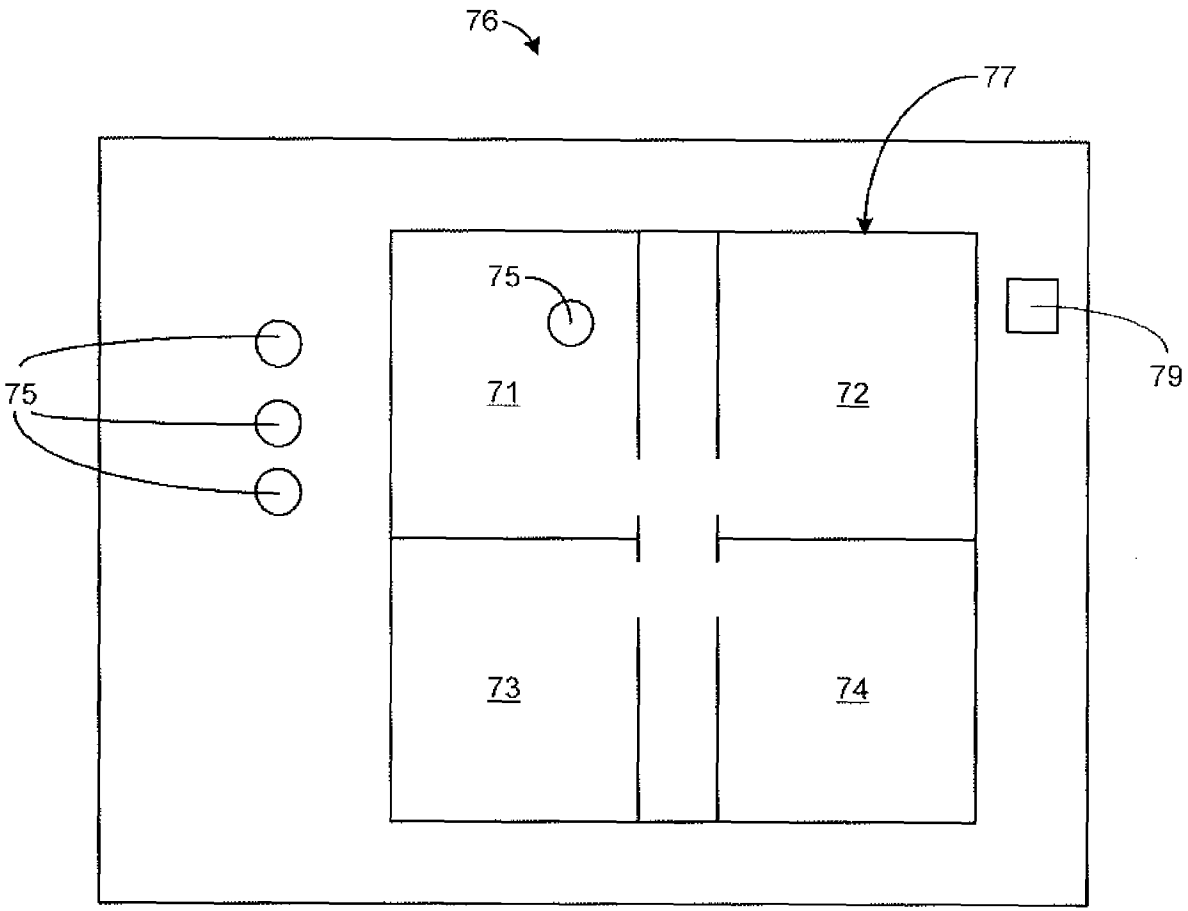
FIG. 7 depicts the GUI of FIG. 6 with a light icon properly positioned upon the map.

Once the user has associated a light source 23 with the icon 75 that represents it, the user may then position the icon 75 in the proper location on the map 77, as shown by FIG. 7, such that the icon's position upon the map 77 corresponds to the actual position of the light source 23 within the room 71 represented by the map 77. In one embodiment, the device 33 allows the user to touch and drag icons 75 in order to move them from one position on the screen to another. In such case, the user can touch via an object (e.g., the user's finger or a stylus) the icon 75 determined to represent a light source 23 and move the icon 75 by dragging such object across the screen until it is at the location on the map corresponding to the light's location in the room 71. As the object moves across the screen, the location of the icon is updated so that the icon is displayed at the object's location. Once the object reaches the location on the map corresponding to the light's location in the room 71, the user may then lift the object from the screen leaving the icon at the proper location on the map. Thus, the icon 75 is moved from an initial position on the map that does not represent the location of a light source 23 in the room, as shown by FIG. 6, to a position on the map that does accurately represent the location of the corresponding light source 23 in the room, as shown by FIG. 7.

In other embodiments, other techniques for updating the location of the icon 75 so that its location represents the location on the map of the corresponding light source 23 are possible. As an example, a user may move an icon 75 by simply touching the screen at the location of the icon 75 to select the icon and then touch the screen at the location that represents on the map the location of the corresponding light source 23. In response, the device 33 moves the selected icon to the location that is subsequently touched.

After an icon 75 is moved, the new coordinates of the icon 75 for the map are saved so that the icon 75 is displayed in the new location when the map is viewed in future sessions. In this regard, the control logic 61 of the device 33 is configured to update the light location data 63 such that the light identifier of the light source 23 represented by the moved icon 75 is mapped to coordinates indicating the new location of the icon 75. Note that the user may repeat the aforementioned process for the other icons 75 until all of the icons 75 corresponding to the light sources 23 in the room 71 are respectively positioned in their proper positions upon the map 77. The user may then move to a different room 72-74 in the environment in order to place icons 75 representing lights in the other rooms 72-74 in their proper positions on the map 77, as described above. That is, the user may repeat the process for each room 71-74 until the icons 75 corresponding to all of the light sources 23 in the building are placed in their proper positions on the map 77 and the light location data 63 has been appropriately updated. If desired, the light location data 63 may be uploaded to the server 12 so that the data 63 can be used in conjunction with the map data 43 at the server 12 to appropriately position of icons 75 when the map data 43 is displayed in the future.

Note that similar techniques may be used to properly position icons representing sensors 27. In this regard, each sensor element 18 may have an output device (not shown), such as a light (e.g., an LED) that can be selectively controlled by the element's controller 21. Such output device can be used to provide feedback for the user in identifying a sensor 27 of interest. As an example, when device 34 is in close proximity to the sensor 27, a sensor icon 79 representing the sensor 27 may be displayed via the device 33, as described above for a light source 23 when the light source 23 is determined to be in close proximity to the device 34. In response to selection of the sensor icon 79 by the user, the system 10 may change the state of the output device of the corresponding sensor element 18 (i.e., the sensor element 18 having the sensor 27 represented by the selected icon 79), as described above for a light source 23 when the light's corresponding icon 75 is selected by a user. Thus, by observing the output device of the sensor 27 of interest, the user can determine whether the selected icon 79 corresponds to such sensor 27.

In some embodiments, a sensor element 18 may not be equipped with an output device for providing feedback, as described above. In such case, activation of the sensor 27 may be used to confirm whether it is represented by a selected icon 79. For example, after selecting an icon 79, the user may activate the sensor 27 that he or she believes is represented by the selected icon 79. Upon activation of such sensor 27, the controller 21 coupled to such sensor 27 transmits a message indicating that activation of the sensor 27 has been detected. The control logic 30 of the server 12 may be configured to transmit to the device 33 a message indicating such activation. If the sensor identifier of the activated sensor 27 matches the sensor identifier associated with the selected icon 79, then the device 33 displays a message indicating such match. If such identifiers do not match, then the device 33 displays another message indicating that no match was found. Accordingly, based on the message output by the device 33, the user can determine whether the selected icon 79 corresponds to the sensor 27 of interest.

Accordingly, the map 77 is updated to have light icons 75 and sensor icons 79 respectively representing light sources 23 and sensors 27 of the system 10. The light location data 63 maps light identifiers and sensor identifiers to map locations corresponding to the actual locations of the light sources 23 and sensors 27 respectively identified by such identifiers, as described above. Such map data 43 may be displayed to a user to facilitate the process of defining the light configuration data 41. As an example, a user may access the map data 43 and light location data 63 via the communication device 33, which displays the map defined by such data 43, including icons 75 and 79. Using the icons 75 and 79 as references, the user may then map light sources 23 to control events and states for controlling the operation of the light sources 23 in a desired manner.

As a mere example, assume that a user desires to define a scene in which a particular light source 23, referred to hereafter as "Light B," is to be dimmed to 50% of its maximum brightness and that the scene is to occur in response to activation of a particular sensor 27, referred to hereafter as "Sensor B." The user initially provides an input indicating that he or she would like to define a new scene. In response, the control logic 61 prompts the user for information pertaining to the scene. As an example, the control logic 61 prompts the user to define a scene name that identifies the scene from other scenes that might be defined by the user.

The control logic 61 also requests the user to indicate which lights are to be controlled in the scene. In response to such a prompt, the user selects the icon 75 representing the Light B. Note that such selection is based on the location of the foregoing icon 75 in the displayed map. In this regard, the user may be unaware of the light identifier of Light B, but the user likely knows the location of Light B in the rooms of the displayed map. Thus, the user selects the icon 75 that is displayed at the location in the map corresponding to the actual location of Light B in the room. Based on such input, the control logic 61 looks up the light identifier of the selected icon 75 (which represents Light B in this example) in the light location data 63. This light identifier is then used to define the scene in the light configuration data 41, as will be described in more detail hereafter.

Once the user has selected the icon 75 representing Light B, the control logic 61 prompts the user for information indicative of how Light B is to be controlled during the scene. In response, the user provides an input (e.g., a brightness value or an input indicative of a brightness value) indicating the brightness level at which Light B is to be set during the scene.

The control logic 61 further prompts the user to indicate a control event for triggering the scene. In response to such prompt, the user selects the icon 79 representing sensor B. Note that such selection is based on the location of the foregoing icon 79 in the displayed map. In this regard, the user may be unaware of the sensor identifier of Sensor B, but the user likely knows the location of Sensor B in the rooms of the displayed map. Thus, the user selects the icon 79 that is displayed at the location in the map corresponding the actual location of Sensor B in the room. Based on such input, the control logic 61 looks up the sensor identifier of the selected icon 79 (which represents Sensor B in this example) in the light location data 63. This sensor identifier is then used to define the scene in the light configuration data 41, as will be described in more detail hereafter.

In this regard, the control logic 61 transmits to the server 12 information indicative of the user inputs in defining the scene. As an example, the control logic 61 transmits the scene name, the light identifier of Light B, the brightness value for Light B during the scene, and the sensor identifier of Sensor B. Based on such information the control logic 30 of the server 12 is configured to update the lighting configuration data 41 such that the scene is defined by such data 41. As an example, the control logic 30 may create an entry that correlates at least a scene identifier, which may be assigned by the control logic 30, to the scene name, the light identifier of Light B, the brightness value for Light B, and the sensor identifier of Sensor B. Such data may be pushed to the lighting element 17 for Light B in the element configuration process described above so that the controller 21 of such lighting element is aware that activation of the Sensor B triggers the identified scene, which calls for Light B to be set to a 50% brightness level.

Thereafter, during operation, when sensor B is activated, the controller 21 that is coupled to Sensor B broadcasts a message indicating the occurrence of such activation. Such message preferably includes the sensor identifier of Sensor B. Upon receiving such message, the controller 21 coupled to Light B compares the sensor identifier of the message to the data pushed to such controller 21 during the element configuration process. Based on such comparison, the controller 21 is aware that activation of the identified sensor 27 is of interest to the controller 21 and, specifically, the controller 21 should dim Light B to a 50% brightness level. Accordingly, the controller 21 so controls Light B thereby effectuating the scene that is triggered via activation of Sensor B. The controllers 21 of other lighting elements 17 and sensor elements 18 that do not pertain to the scene simply retransmit the message according to the multicasting techniques described above such that the message is ideally received by each lighting element 17 of the system 10. Thus, each lighting element 17 should have the opportunity to determine whether the message is of interest for controlling one or more of the element's light sources 23.

Using similar techniques, a user can define various control events that cause light sources 23 to be controlled in any desired way based on events sensed by the sensors 27. Further, the scene described above pertains to a single light (i.e., Light B), but any scene may be defined by the user to pertain to any number of light sources 23. Further, it should be noted that the entire process of defining the lighting configuration data 41, pushing the data 41 to the elements 17 and 18, and operating the system 10 can be performed without the user ever being aware of the light and sensor identifiers. In this regard, the light sources 23 and sensors 27 are installed, and the system 10 learns the correct mappings for light and sensor identifiers to the light sources 23 and sensors 27 via the commissioning process described above without a user having to know which identifiers map to which light sources 23 or sensors 27. Accordingly, the light sources 23 and sensors 27 may be installed at any location without having to worry about the light and sensor identifiers that are used by the system 10. Such a feature facilitates the installation process and prevents errors that otherwise could arise when a particular light source 23 or sensor 27 is installed at a wrong location.

Note that the techniques described herein for mapping light and sensor identifiers to the appropriate light sources 23 and sensors 27, respectively, are not limited to situations in which the light sources 23 and sensors 27 are installed in rooms of buildings. The light sources 23 and sensors 27 may be installed in any environment, including an outdoor environment.

Figure 8:
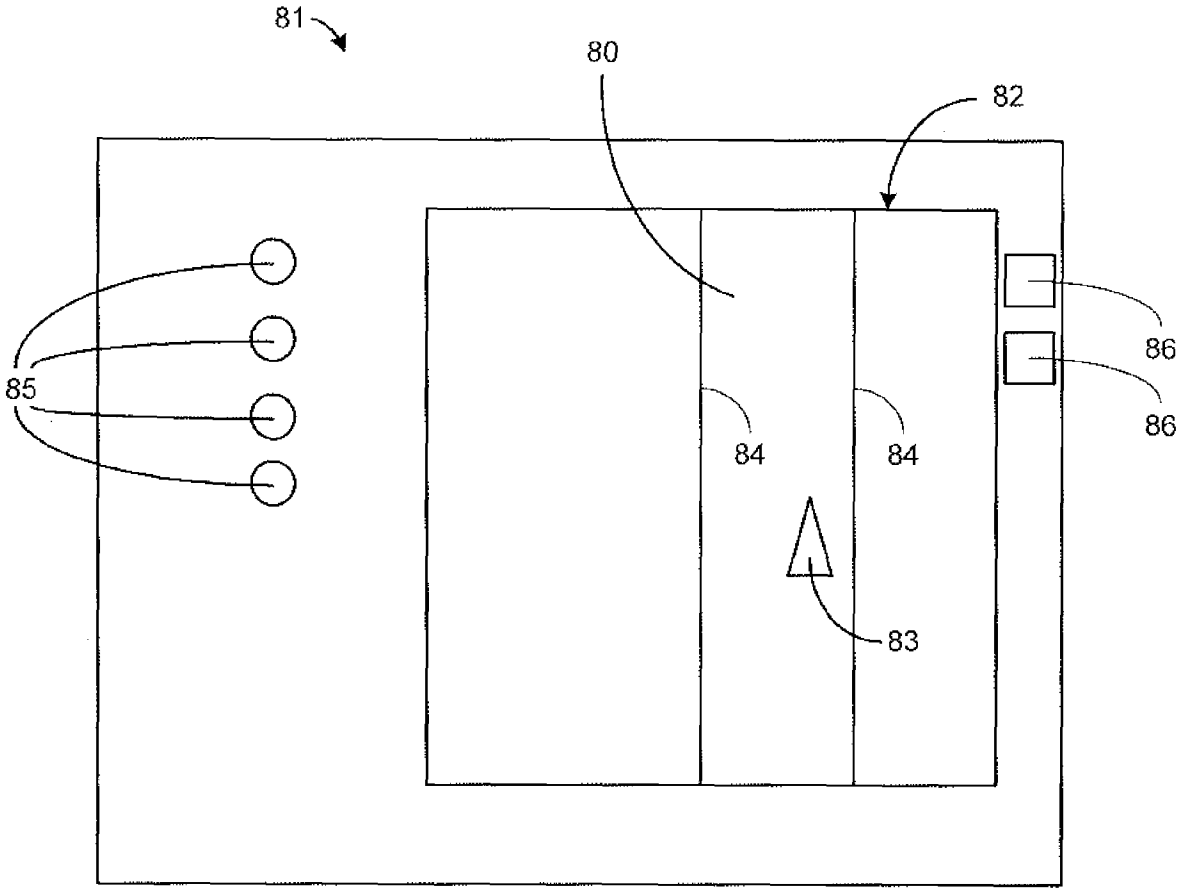
FIG. 8 depicts a GUI displaying a map of a street.

Indeed, referring now to FIG. 8, assume that the lighting control system 10 comprises an outdoor street lighting system wherein the light sources 23 (FIG. 1) are positioned along a street 80, which is displayed on the device 33. In this regard, the lines 84 shown in FIG. 8 represent the edges of the street 80. Also assume that the device 33 (FIG. 1) comprises a location sensor (not shown) for automatically sensing the location of the device 33. As an example, the location sensor may comprise a global positioning system (GPS) receiver (not shown) for determining the GPS coordinates of the device 33. For illustrative purposes, the location sensor will be described hereafter as determining the GPS location of the device 33, but in other embodiments, non-GPS sensors may be used.

The user may take the device 33 into the environment and access map data 43 from the server 12, as set forth above, in order to display a map 82 of the environment on the device 33 through a GUI 81. Based upon the GPS location of the device 33, the GUI 81 displays a device icon 83 indicating the position and orientation of the device 33 with respect to the map 82.

Figure 9:
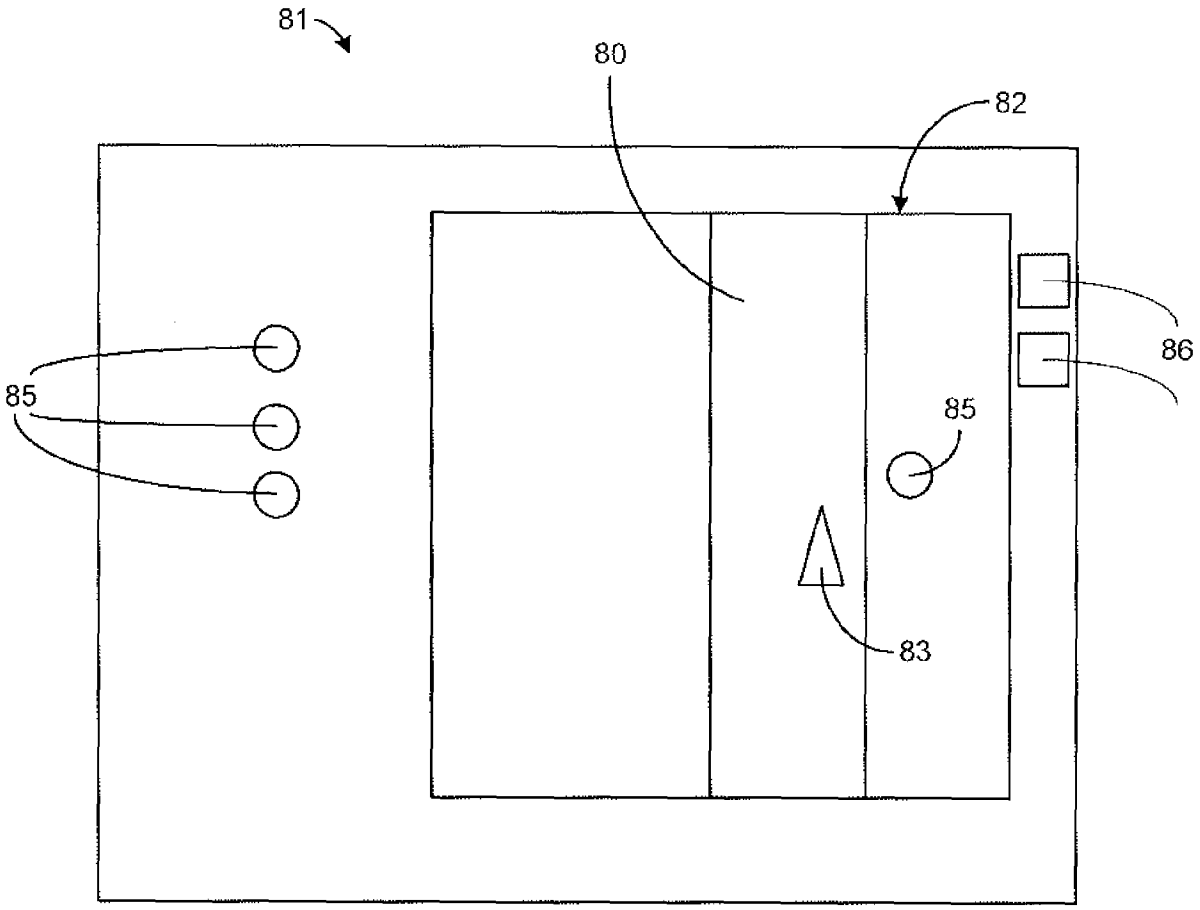
FIG. 9 depicts the GUI of FIG. 8 with a light icon properly positioned upon the map.

The operation of the system 10 is essentially the same as described above except that the user has an additional reference (i.e., icon 83) in defining the positions of light icons 85 and sensor icons 86. In this regard, light icons 85 and sensor icons 86 in close proximity to the device 34 (FIG. 1), based on the received signal strength of a proximity signal transmitted by the device 34, are displayed to the user while viewing the map 82 according to the techniques described above for displaying light icons 75 and sensor icons 79 in FIG. 6. FIG. 8 depicts four light icons 85 and two sensor icons 86 indicating that four light sources 23 and two sensors 27 are within close proximity to the device 34, but different numbers of icons 85 and 86 may appear on the GUI 81 depending on the number of light sources 23 and sensors 27 in close proximity to the device 34. The user may selectively move the icons 85 and 86 to their appropriate positions on the map 82, as described above. However, the reference icon 83 may be used to help the user in positioning the icons 85 and 86. For example, to mark the position of a light source 23 that is just to the right of the user, the user can move the corresponding icon 85 to a corresponding location relative to the icon 83 (i.e., just to the right of the reference icon 83 in this case), as shown by FIG. 9. Thus, the presence of the icon 83 assists the user in finding the correct location of the icon 85 on the map 82.

It should be noted that it is unnecessary for the icons to be moved to their proper positions on a map in order for a user to define the configuration data 41. As an example, a user may use similar techniques to identify light sources 23 and/or sensors 27 when defining the configuration data 41. In this regard, as described above, when a user desires to select a light source 23 for inclusion in a zone or scene, the user may take the devices 33 and 34 to the room where the light source 23 is located and cause the device 34 to transmit the proximity signal. In response, the device 33 receives the light identifiers of light sources 23 that are determined to be in close proximity of the device 34, as described above. The device 34 may display an icon 75 for each respective light identifier, as described above. Further, the user may select an icon 75 thereby causing the corresponding light source 23 to change state in order to identify the light source 23 of interest, as described above. Rather than moving the icon 75, the user may select the icon 75 for inclusion of the corresponding light source 23 into a scene or zone being defined by the user while configuring the data 41. As an example, in response to a prompt requesting the user to indicate which light source 23 is to be included in a particular zone or scene, the user may select the icon 75 that has been confirmed by the user to represent the light source 23 of interest. Thus, the proper light identifier for the scene or zone can be identified without the corresponding light icon being moved to a position on the map corresponding to the light's actual location. Yet other techniques may be used to identify light sources 23 and/or sensors 27 of interest.

Note that, if desired, the functionality of the wireless communication device 34 may be incorporated into the communication 33 such that a single device 33 may be carried and used by the user during the commissioning process. That is, the communication device 33 may be configured to transmit the proximity signal. In addition, it is possible for the server 12 to be in direct communication with a node, such as an element 17 or 18, such that it is unnecessary for a separate network 15 to be used for communication between the server 12 and the elements 17 and 18. In an alternative embodiment, some of the functionality described above for the server 12 may be implemented at another location, such as the gateway 14. As an example, for the element configuration process, the server 12 may be configured to transmit the lighting configuration data 41 to the gateway 14, which is configured to push such data 41 to the elements 17 and 18 in successive stages, as described above. One advantage of such an approach is that the messages carrying the slices of configuration data 41, the multicast pings, and the replies to the multicast pings do not need to be communicated over the network 15. In other embodiments, yet other changes and modifications are possible.

Figure 10:
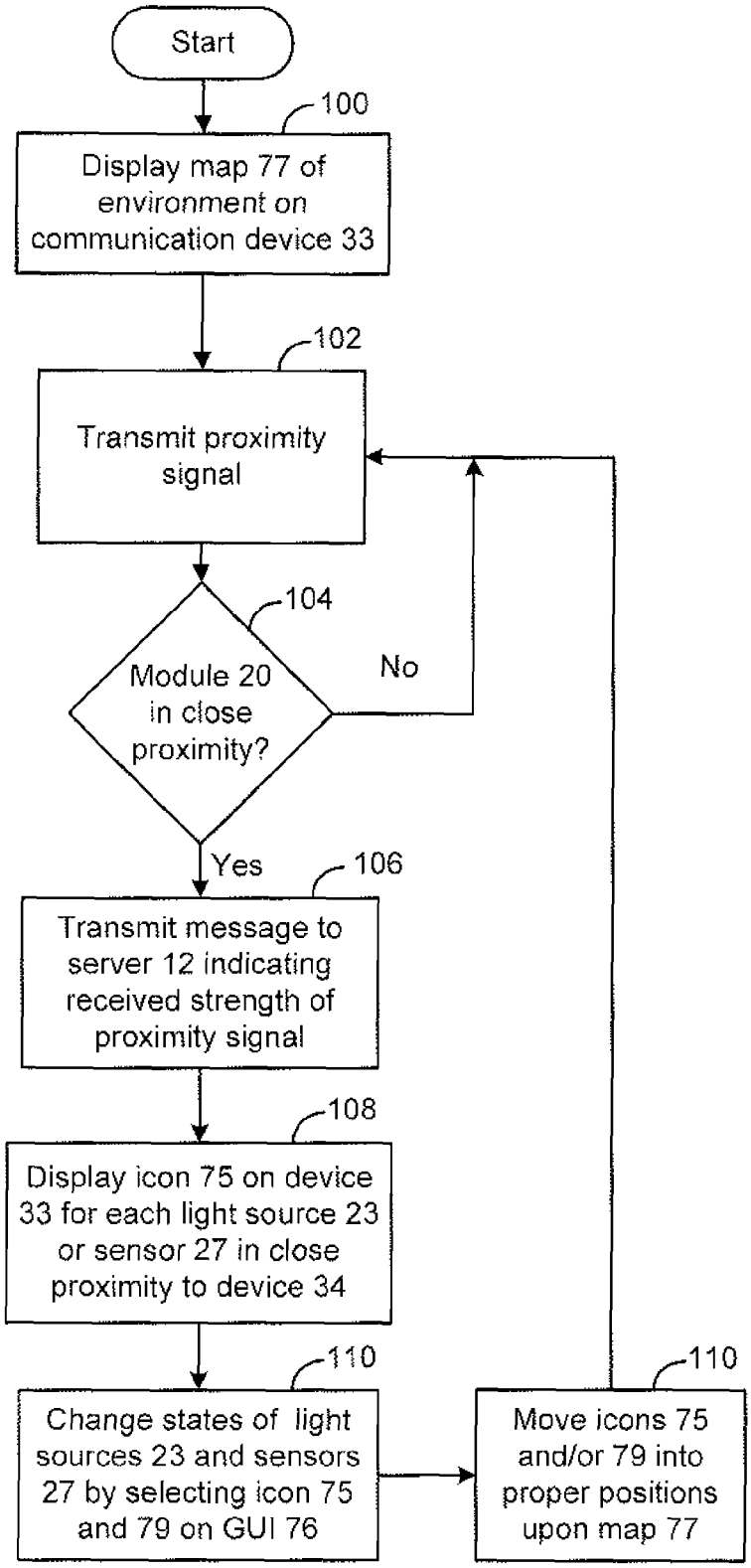
FIG. 10 is a flowchart illustrating an exemplary lighting control method.

An exemplary operation and use of the system 10 in commissioning the system after installation will be described in more detail below with particular reference to FIG. 10. For illustrative purposes, assume that the communication device 33 comprises a tablet and the I/O interface 70 comprises a touch screen. Further assume that the user is commissioning a building having a plurality of rooms 71-74.

The user downloads the map 77 for the building by using the device 33 to access the map data 43 stored in the server 12 via the network 15. The device 33 displays the map 77 via a GUI 76 in the web browser 64, as shown by block 100 of FIG. 1. The user then takes the devices 33 and 34 into the building and enters a room 71 of the building. The wireless communication device 34 transmits a proximity signal to the network modules 20 within range of the device 34 to facilitate identification of the modules 20 within a close proximity of the device 33, as shown by block 102. If a module 20 is determined to be within close proximity of the device 33, as shown by block 104, the controller 21 coupled to such module 20 transmits a message to the server 12 via the wireless network 19 indicating the light and/or sensor identifiers of the light sources 23 and/or sensors 27 coupled to such controller 21. The message also indicates the strength of received proximity signal, as shown by block 106. Preferably, each light source 23 or sensor 27 is positioned relatively close to the module 20 servicing it such that it can be assumed that the light source 23 or sensor 27 identified by the foregoing message is in close proximity to the device 34.

For each light source 23 or sensor 27 identified to be in close proximity to the device 34, the server 12 transmits the light or sensor identifier to the device 33 via the network 15, and the device 33 displays an icon 75 or 79 on the GUI 76 corresponding to such light source 23 or sensor 27, as shown by block 108. In one embodiment, the device 33 displays the icons 75 in order from the strongest signal received from the device 34 to the weakest signal received from the device 34 in order to indicate which light source 23 is most likely closest to the device 34.

The user selectively changes the state of an individual light source 23 by selecting the icon 75 on the GUI 76 that corresponds to the light source 23, as shown by block 110. When the user selects an icon 75 on the GUI 76, the user may observe which light source 23 in the building changes state in response to the user selecting the icon 75. The user then identifies the light source 23 corresponding to the icon 75 and drags and drops the icon 75 into the proper position within the room 71 on the map 77, as shown by block 112. The user may place the icon 75 for each light source 23 in the room 71 in its proper position upon the map 77, and the user may also move the sensor icons 79 to their proper positions as well via similar techniques as described above.

After moving each displayed icon 75 and/or 79, the user moves to the next room 72. The device 34 then transmits another proximity signal resulting in new icons 75 and/or 79 being displayed, and the user repeats the process of placing the displayed icons 75 and/or 79 in their proper respective positions upon the map 77, as shown by block 110. The user then proceeds to all of the remaining rooms 73-74 in the building. Accordingly, a map 77 is provided having icons 75 and 79 that represent light sources 23 and sensors 27 and that are positioned on the map 77 according to the respective positions of the corresponding light sources 23 and sensors 27 in the building. The user may then use the map 77 to define configuration data 41, according to the techniques described herein.

In one embodiment, the controller 21 of a particular lighting element 17 is configured to communicate with the controller 21 of a corresponding sensor element 18 in order to perform a process, referred to hereafter as the "driver calibration process." In this regard, oftentimes the brightness of light produced by a particular light source 23 is not directly proportional to the amount of input voltage supplied to its light driver 22 by the controller 21. Thus, the relationship between the input voltage to the light driver 22 and the brightness from the light source 23 is nonlinear. For example, if a controller 21 supplies a range of 0 to 10 Volts (V) to its driver 22 and a user desires for the light source 23 to produce a brightness value of 25% of the possible brightness of the light source 23, an input voltage of 2.5 V typically does not produce light having a 25% brightness value. Note that a brightness value percentage stated herein refers to a percentage of a maximum brightness level for the associated light source 23. As an example, a 25% brightness value for a light source 23 refers to a state in which the light source 23 is emitting light at 25% of its maximum brightness.

Figure 11:
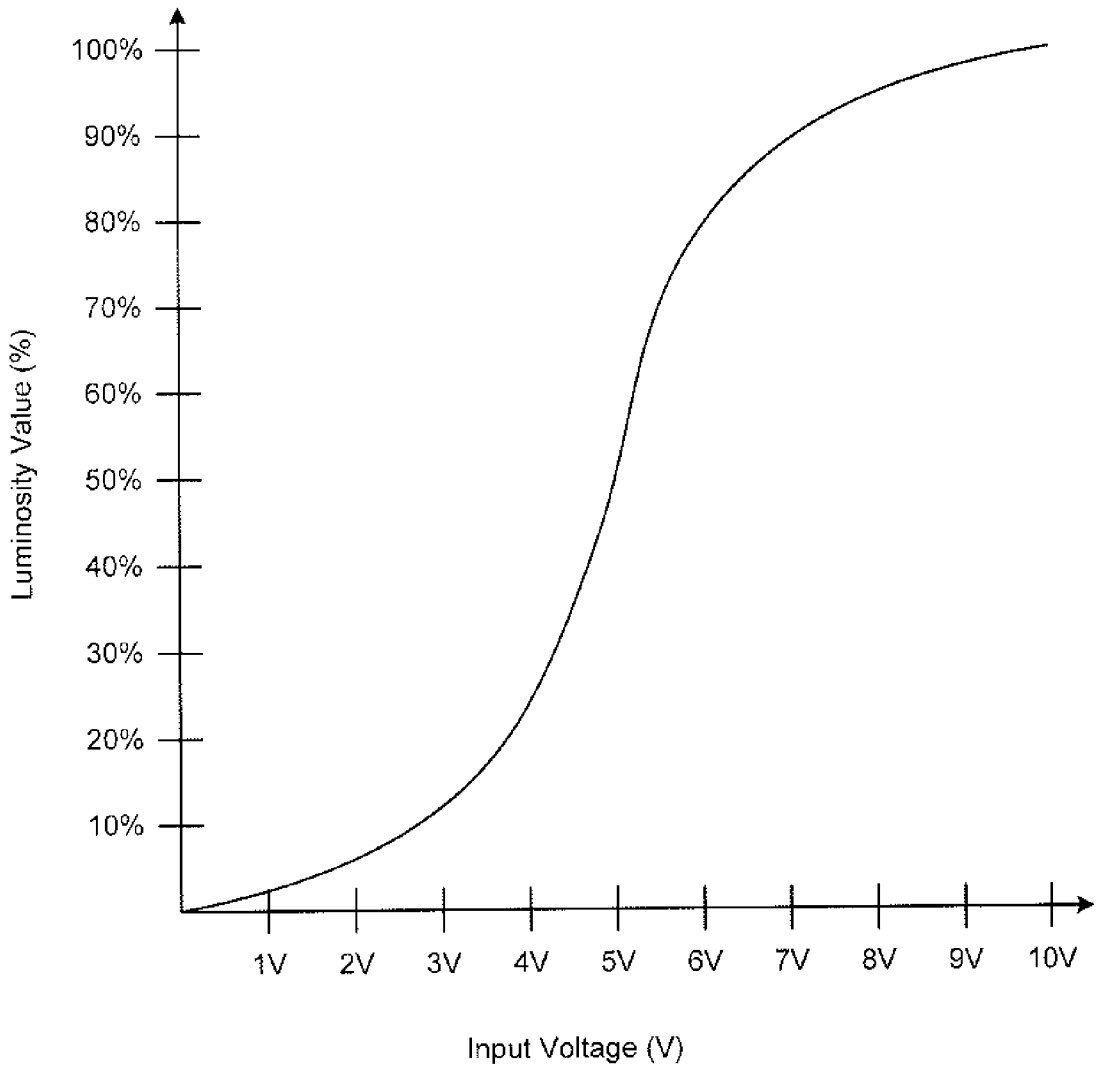
FIG. 11 is a graph illustrating an exemplary relationship between the input voltage to a light driver and brightness of light emitted from the light source driven by the light driver.

FIG. 11 depicts a graph illustrating an exemplary relationship between the input voltage to a light driver 22 and the brightness of light emitted from the light source 23, but different relationships between the input voltage and the brightness are possible in other embodiments. For the light driver 22 illustrated by FIG. 1, an input voltage of 2.5 V produces a brightness value of less than 10%. In order for such light driver 22 to produce light having a brightness value of 25%, the controller 21 supplies an input voltage of approximately 4 V. Thus, assuming a linear relationship between the input voltage to such driver 22 and the output brightness value produces an undesirable or unexpected result.

In one exemplary embodiment, a controller 21 performs the driver calibration process in order to map an input voltage to a desired brightness output. In this regard, the controller 21 of a lighting element 17 communicates via the wireless network 19 with the controller 21 of a sensor element 18 in order to determine the input voltages required to produce a plurality of brightness values measured by the sensor 27. In one embodiment, the sensor 27 of such element 18 is installed in an environment, such as, for example, a building, and is positioned to detect light emitted by the light source 23 of the lighting element 17. In other embodiments, other types of sensors 27, such as mobile sensors, may be used.

When the sensor 27 is in position to detect light emitted from the light source 23, the controller 21 of the light source 23 ramps the input voltage provided to the light driver 22 through a range of possible input voltages (e.g., 0-10 V) and communicates with the controller 21 of the sensor 27 to determine the input voltages corresponding to a plurality of desired brightness values measured by the sensor 27. In one exemplary embodiment, the controller 21 of the light source 23 determines the input voltages respectively corresponding to ten brightness values, (e.g., 10%, 20%, 30%, 40%, 50%, 60%, 70%, 80%, 90%, and 100%), but other numbers of brightness values are possible in other embodiments.

In one example, as shown by FIG. 11, the controller 21 of the light source 23 determines that an input voltage of approximately 2.75 V produces about 10% brightness, approximately 3.75 V produces about 20% brightness, approximately 4.25 V produces about 30% brightness, approximately 4.75 V produces about 40% brightness, approximately 5 V produces about 50% brightness, approximately 5.25 V produces about 60% brightness, approximately 5.5 V produces about 70% brightness, approximately 6 V produces about 80% brightness, approximately 7 V produces about 90% brightness, and approximately 10 V produces about 100% (i.e., maximum) brightness.

For each measurement, the controller 21 of the light source 23 sets the input voltage of the light driver 22 to a predefined level (such as 2.75 V for the first measurement indicated above). After the desired input voltage is set, the controller 21 of the light source 23 transmits a message to the controller 21 of the sensor 27 requesting such controller 21 to provide a reading from the sensor 27. In response, the controller 21 of the light sensor 27 takes a reading of the sensor 27 and transmits a reply message indicating the brightness value read. Upon receiving the message, the controller 21 of the light source 23 stores a value indicative of the input voltage for the measurement and a value indicative of the brightness measured by the sensor 27 while the light driver 22 is receiving the indicated input voltage. The controller 21 of the light source 23 further correlates such values so that it can be later determined that they are associated with the same measurement. The controllers 21 of the light source 23 and the sensor 27 repeat aforementioned process for each measurement thereby defining a set of calibration data that can be used to precisely control the light driver 22 such that the light source 23 emits a desired brightness. In one embodiment, the controller 21 of the light source 23 stores the input voltages and corresponding brightness values locally at such controller 21, but the data may be stored in other locations, such as, for example, the server 12, in other embodiments.

Once the driver calibration process for a light source 23 is complete, the controller 21 of the light source 23 is configured to access the brightness calibration data in order to provide the appropriate input voltage to the driver 22 for any light state specified for the light source 23 by the lighting configuration data 41 (FIG. 2), such as, for example, fading, dimming, on or off. Furthermore, the driver calibration process can be performed for each light source 23 in an environment such that the controller 21 for each light source 23 is configured to provide the appropriate input voltage to the driver 22 for a desired brightness value.

In this regard, when a controller 21 for a lighting element 17 is to set its light source 23 to a particular brightness value during operation, the controller 21 is configured to access its calibration data in order to map the desired brightness value to an input voltage value. In one embodiment, the controller 21 interpolates between brightness and input voltage values stored in the calibration data in order to determine the appropriate input voltage value for the specified brightness. The controller 21 of the light source 23 then provides an input voltage to the driver 22 in accordance with the calculated input voltage value. As an example, if a scene specifies that the light source 23 is to be set to 70% brightness, then the controller 21, based on the calibration data, provides an input voltage of about 5.5 Volts, which should cause the light source 23 to emit light at the desired brightness. Notably, 5.5 V is less than 70% of the maximum input voltage for the given operating range. Accordingly, by using the calibration data, as described above, the light source 23 can be controlled such that the actual brightness of the light source 23 varies linearly with the brightness values that are used to control the light source 23.

Also, in one embodiment, a plurality of lighting controllers 21 may simultaneously communicate with the controller 21 of the sensor 27 in order to calculate an input voltage to be supplied by each controller 21 in order to produce a median brightness value for the environment.

Referring again to FIG. 1, in one embodiment, the controller 21 of at least one lighting element 17 in an environment, such as, for example, a room of a building, is configured to communicate with the controller 21 of at least one sensor element 18 in the same environment in order to perform a daylight harvesting calibration. In this regard, there may be a plurality of sensors 27 positioned throughout the environment for determining brightness values of light at a plurality of locations within the environment. For a given location within the environment, such as a desk in the room of the building, the brightness may change throughout the day due to environmental factors, such as, for example, varying levels of sunlight entering the environment or other reasons.

In many conventional lighting systems, a given light source outputs light at a certain brightness regardless of the current lighting characteristics in the room. Such brightness level is usually set such that there is a desired amount of brightness in the room regardless of other factors, such as the amount of sunlight entering the room. Such an approach needlessly wastes energy when there is a significant presence of light from sunlight or other sources. For example, if there is a significant amount of sunlight entering a room, then the output of a given light source may be reduced while still achieving a desired brightness level within the room. Also, it is possible that there may be several light sources in a room that illuminate a given area, such as a desktop where a user may work. When multiple light sources are actively emitting light, it is possible that a particular light source for illuminating the area may be reduced while still achieving a desired brightness for the area.

In one exemplary embodiment, a process (referred to herein as "daylight harvesting calibration") is used to calibrate at least one light source 23, referred to hereafter as the "daylight harvesting (DLH) light source," for illuminating a given area in order to allow the brightness of light from such DLH light source 23 to vary based on the amount of light affecting such area from other sources of light, such as sunlight or other light sources 23, while still ensuring a certain brightness level for the area. In particular, during conditions when there is a significant amount of light from other sources illuminating the area, the brightness of light emitted by the DLH light source 23 is decreased thereby conserving power. As the amount of light from other sources decreases, the brightness of light emitted from the DLH light source 23 may be increased in order to ensure that the brightness of the area remains at or above a desired threshold.

In order to reduce the effects of light from external sources in the daylight harvesting calibration, such calibration is preferably performed when there is not a significant presence of light from external sources, such as at night when there is very little or no sunlight entering the environment. In one exemplary embodiment, a user enters the environment at night and initiates the daylight harvesting calibration, such as, for example, via the communication device 33. In this regard, the user provides an input for requesting initiation of the daylight harvesting calibration, and such request is transmitted to the server 12. Such request may identify which light sources 23 are to be calibrated, such as the light sources 23 that are within and/or affect an area of interest, such as a room of a building.

Upon receiving the request, the control logic 30 of the server 12 is configured to communicate with the controllers 21 of the elements 17 and 18 to be used in the calibration and instruct such controllers 21 to initiate the calibration. During the calibration, each light source 23 is calibrated one-by-one until all of the involved light sources 23 are calibrated. For each light source 23 being calibrated, its controller 21 ramps the light source 23 through a predefined range of brightness values in order to determine its impact on each sensor 27 involved in the calibration (e.g., in the environment). Such ramping preferably occurs while the other light sources 23 affecting such sensors 27 are turned off (i.e., not emitting light).

In this regard, for each light source 23 to be calibrated, the controller 21 sets the brightness of the light emitted from the light source 23 to a first level and then communicates with the controller 21 of one of the sensors 27 involved in the calibration in order to determine the effect of such light on the sensor 27. That is, after setting the output of the light source 23, the controller 21 of the light source 23 communicates via the network 19 with the controller 21 of given sensor 27 involved in the calibration in order to determine the brightness measured by the sensor 27. Note that if the calibration is indeed performed when there is very little light from external sources and when the other light sources 23 affecting the sensor 27 are turned off, then the measurement should indicate the extent to which the light source 23 impacts the brightness measured by the sensor 27 when the light source 23 is set to the current brightness level of the calibration.

In one embodiment, the controller 21 of the sensor 27 transmits to the controller 21 of the light source 23 via the network 19 a message indicating the brightness measured by the sensor 27. The controller 21 of the light source 23 then stores the measured brightness value and correlates the measured brightness value with the brightness value that was used to set the input voltage of the driver 22 for the measurement. The controller 21 of the light source 23 (by adjusting the input voltage of the driver 22) then changes (e.g., increases) the brightness of the light output by the light source 23 and repeats the aforementioned process of determining the brightness measured by the sensor 27. Such process is repeated until measurements across a predefined range of brightness levels of the light source 23 have been taken. The data defining such measurements shall be referred to hereafter as "DLH calibration data." Once the aforementioned process has been performed for a given sensor 27, the DLH calibration data respectively maps brightness values of the light source 23 (i.e., brightness values used to set the input voltage of the driver 22) to corresponding measured brightness values received from the sensor 27. Thus, the DLH calibration data can be analyzed to determine what brightness should be measured by the sensor 27 for a given brightness level of the light source 23, assuming that the sensor 27 is not sensing a significant amount of light from other sources of light.

Once the daylight harvesting calibration for the light source 23 is complete with respect to a given sensor 27, the controller 21 of the light source 23 repeats the aforementioned process for another sensor 27 involved in the calibration. Further, the controller 21 of the light source 23 transmits DLH calibration data to the server 12, which stores such data for later use, as will be described in more detail hereafter.

After completing the daylight harvesting calibration for a given lighting element 17, its controller 21 turns off the light source 23, and the controller 21 of another lighting element 17 performs the calibration for its light source 23 while ramping the brightness of such light source 23 through a range of brightness values, as described above, in order to determine that light's impact on each sensor 27 in the environment. The process is repeated one-by-one for each light source 23 in the environment until the daylight harvesting calibration for each light source 23 is complete.

In addition, a user also selects a desired brightness level or threshold for a location in the environment. As an example, the user may define a scene in which one or more light sources 23 are controlled in order to set the brightness measured by a particular sensor 27 to at least a specified threshold. In one embodiment, the user utilizes the communication device 33 in order to select a desired brightness threshold for a particular sensor 27, but other means for selecting the desired brightness threshold are possible in other embodiments.

As an example, a user may submit inputs via the sensors 27 and/or the communication device 33 in order to control the light sources 23 in any desired manner for producing a desired brightness in a particular area in which a sensor 27 is located. Once the desired brightness is achieved, the user may provide an input to the communication device 33 requesting the system 10 to calibrate to the desired brightness for the particular sensor 27. Such request may identify the sensor 27 being calibrated and is transmitted to the server 12. In response, the control logic 30 at the server 12 communicates with the controller 21 of the identified sensor 27 to learn the brightness value measured by the sensor 27 at about the time of receiving the request. The control logic 30 then stores this value in the lighting configuration data 41 as a threshold for the sensor 27. As an example, the user may access the server 12 via the communication device 33 and network 15 to define a scene in which the system 10 controls one or more light sources 23 in the room of the sensor 27 based on the threshold so that the brightness measured by the sensor 27 is maintained close to the threshold, as will be described in more detail below. Such process may be repeated as desired for any of the sensors 27 in the environment.

In one embodiment, the control logic 30 of the server 12 implements a daylight harvesting algorithm for controlling the controllers 21 of the light sources 23 in order to produce a desired brightness value for the sensor 27. In this regard, in implementing a scene or otherwise, the controller 21 of a sensor 27 may be configured to monitor the brightness values measured by the sensor 27 and to determine whether the measured value exceeds a threshold, such as the threshold set by the user, as described above. If the measured value exceeds the threshold by more than a predefined amount, then the controller 21 transmits a message to the server 12 via the network 19 indicating that the brightness at the location of the sensor 27 should be decreased. In response, the control logic 30 reduces the brightness of light output by at least one light source 23 affecting the sensor 27 in an effort to lower the brightness at the location of the sensor 27 such that brightness measured by the sensor 27 is closer to the sensor's threshold while still meeting the threshold (e.g., equal to or greater than the threshold).

Alternatively, if the brightness value measured by the sensor 27 is below the sensor's threshold, then the controller 21 transmits a message to the server 12 via the network 19 indicating that the brightness at the location of the sensor 27 should be increased. In response, the control logic 30 increases the brightness of light output by at least one light source 23 affecting the sensor 27 in an effort to increase the brightness at the location of the sensor 27 to a level at or above the threshold.

There are various techniques that can be used to select the light sources 23 to be adjusted and the amount of brightness adjustment. In one exemplary embodiment, the control logic 30 selects the light source or sources 23 to be adjusted based on the DLH calibration data. For example, the control logic 30 may analyze the DLH calibration data in order to identify the light source 23 that has the greatest impact on the measurements of the sensor 27 and to adjust the brightness of the light output by such light source 23 in an effort to achieve the desired brightness level. As an example, the light source 23 that is correlated with the highest brightness measurement by the sensor 27 during DLH calibration might be selected for adjustment. If such light source 23 cannot be adjusted in the desired manner (e.g., if the light source 23 is already at maximum brightness and the brightness at the location of the sensor 27 is to be increased), then the light source 23 having the next most significant impact on the sensor 27 might be selected.

In one embodiment, in an effort to provide more power efficient results, the control logic 30 is configured to select for adjustment the light source 23 for which a given incremental increase in output brightness produces the greatest increase in the brightness sensed by the sensor 27. There are many other types of algorithms that can be used to select one or more light sources 23 for adjustment and/or to select the amount adjustment to any given light source 23. For example, aesthetics or a combination of aesthetics and power efficiency may be used as factors in controlling the light sources 23. Further, the algorithm may take into account multiple sensors 27 in selecting which light source or sources 23 to adjust. As a mere example, if there are two sensors 27 below their respective thresholds, the control logic 30 might select for adjustment the light source 23 having the greatest effect on both sensors 27, as indicated by the DLH calibration data. Yet other techniques of controlling the light sources 23 based on the measurements of one or more sensors 27 and/or the DLH calibration data are possible.

In any event, when the control logic 30 of the server 12 determines that a given light source 23 is to be adjusted, the control logic 30 transmits via the network 19 a message to the controller 21 of the light source 23 instructing such controller 21 to achieve a certain brightness level for the light source 23. In response, the controller 21 adjusts its input voltage to its light driver 22 so that the brightness of the light source 23 is adjusted as requested by the control logic 30 of the server 12.

Now, therefore, the following is claimed:

1. A method, comprising:

storing, in memory, a light identifier identifying a light source;

displaying, by a mobile communication device, a map of an area in which the light source is located;

displaying, by the mobile communication device, a graphical icon representing the light source;

receiving, by the mobile communication device, a first user input for selecting the graphical icon;

wirelessly transmitting from the mobile communication device a message having the light identifier in response to the first user input;

changing a state of the light source in response to the message;

receiving, by the mobile communication device, a second user input for moving the graphical icon relative to the map subsequent to the changing; and moving, by the mobile communication device, the graphical icon to a location on the map corresponding to a location of the light source within the area in response to the second user input.

2. The method of claim 1, further comprising transmitting the light identifier from the memory to the mobile communication device by a network.

3. The method of claim 1, further comprising receiving an input at a lighting element for controlling the state of the light source, wherein the displaying the graphical icon is based on the input received at the lighting element.

4. The method of claim 3, further comprising transmitting the light identifier from the memory to the mobile communication device in response to the receiving the input at the lighting element.

5. The method of claim 4, wherein the input received at the lighting element is transmitted to the lighting element wirelessly.

6. The method of claim 1, further comprising:

receiving a wireless signal at a lighting element for controlling the state of the light source; and measuring a signal strength of the wireless signal;

wherein the displaying the graphical icon is based on the signal strength.

7. The method of claim 6, further comprising comparing the signal strength to a threshold, wherein the displaying the graphical icon is based on the comparing.

8. The method of claim 1, further comprising determining a proximity of a user carrying the mobile communication device relative to the light source, wherein the displaying the graphical icon is based on the determining.

9. The method of claim 8, wherein the determining is based on a wireless signal communicated between the mobile communication device and a lighting element controlling the light source.

10. The method of claim 9, wherein the determining is based on a received signal strength of the wireless signal.

11. The method of claim 1, further comprising updating, in memory, coordinates for the graphical icon in response to moving the graphical icon, the updated coordinates corresponding to the location of the graphical icon on the map resulting from the second user input.

12. The method of claim 1, further comprising displaying, by the mobile communication device, a graphical icon representing the mobile communication device on the map at a location corresponding to a location of the mobile communication device within the area.

13. The method of claim 1, further comprising transmitting, by a server, a command to a lighting element controlling the light source, wherein the changing is in response to the command.

14. The method of claim 1, wherein the moving is in response to the changing.

15. The method of claim 14, further comprising determining, prior to the updating, a proximity of a user carrying the mobile communication device relative to the light source, wherein the displaying the graphical icon is based on the determining.

16. The method of claim 15, wherein the determining is based on at least one wireless signal communicated between the mobile communication device and a lighting element controlling the light source.

17. The method of claim 1, further comprising:

defining the map with map data, wherein prior to the moving the light identifier is not correlated by the map data with the location on the map corresponding to the location of the light source within the area, and wherein the displaying the map is based on the map data; and updating the map data based on the moving such that the map data correlates the light identifier with the location on the map corresponding to the location of the light source within the area.

18. The method of claim 17, wherein the displaying the graphical icon comprises displaying within a graphical user interface a plurality of graphical icons representing light sources, wherein the plurality light sources includes the light source identified by the light identifier, and wherein the method comprises:

determining a proximity of a user carrying the mobile communication device relative to the light source identified by the light identifier; and indicating, with the graphical user interface based on the determined proximity, which of the plurality of light sources is closest to the user prior to the updating.

19. The method of claim 18, wherein the determining is based on a received signal strength of a wireless signal communicated between the mobile communication device and a lighting element controlling the light source identified by the light identifier.

20. The method of claim 1, wherein the displaying a graphical icon includes displaying the graphical icon at a location on the map different from the location on the map corresponding to the location of the light source within the area.

21. A system, comprising:

a lighting element having a light source, the lighting element operable to receive a wireless signal and to transmit a first message in response to the wireless signal, wherein the first message has a light identifier identifying the light source;

a server operable to receive the first message and to transmit a second message having the light identifier in response to the first message; and a mobile communication device operable to display a map of an area in which the light source is located and to display a graphical icon representing the light source in response to the second message, the mobile communication device operable to receive a first user input for selecting the graphical icon and to wirelessly transmit a third message having the light identifier to the server in response to the first user input, wherein the server is operable to transmit a fourth message having the light identifier to the lighting element in response to the third message, wherein the lighting element is operable to change a state of the light source in response to the fourth message, and wherein the mobile communication device is operable to receive a second user input and to move the graphical icon to a location on the map corresponding to a location of the light source within the area in response to the second user input.

22. The system of claim 21, wherein the lighting element is operable to measure a signal strength of the wireless signal and to transmit the first message based on the signal strength.

23. The system of claim 21, wherein the server is operable to define the map with map data, and wherein the server is operable to update the map data, based on the second user input, such that the map data correlates the light identifier with the location on the map corresponding to the location of the light source within the area.

24. A method, comprising:

receiving a wireless signal by a lighting element having a light source;

transmitting a first message having a light identifier identifying the light source to a server in response to the receiving the wireless signal;

transmitting a second message having the light identifier from the server to a mobile communication device in response to the first message;

displaying, by the mobile communication device, a map of an area in which the light source is located;

displaying, by the mobile communication device, a graphical icon representing the light source in response to the second message;

receiving, by the mobile communication device, a first user input for selecting the graphical icon;

wirelessly transmitting a third message having the light identifier in response to the first user input;

transmitting a fourth message having the light identifier from the server to the lighting element in response to the third message;

changing a state of the light source in response to the fourth message;

receiving, by the mobile communication device, a second user input for moving the graphical icon relative to the map subsequent to the changing; and moving, by the mobile communication device, the graphical icon to a location on the map corresponding to a location of the light source within the area in response to the second user input.

25. The method of claim 24, further comprising measuring a signal strength of the wireless signal, wherein the transmitting the first message is based on the signal strength.

26. The method of claim 25, further comprising comparing the signal strength to a threshold, wherein the transmitting the first message is based on the comparing.

27. The method of claim 24, further comprising determining a proximity of a user relative to the light source based on the wireless signal.

28. The method of claim 24, further comprising updating, at the server, coordinates for the graphical icon in response to moving the graphical icon, the updated coordinates corresponding to the location of the graphical icon on the map resulting from the second user input.

29. The method of claim 24, further comprising displaying, by the mobile communication device, a graphical icon representing the mobile communication device on the map at a location corresponding to a location of the mobile communication device within the area.

30. The method of claim 24, further comprising:

defining the map with map data, wherein prior to the moving the light identifier is not correlated by the map data with the location on the map corresponding to the location of the light source within the area, and wherein the displaying the map is based on the map data; and updating the map data based on the moving such that the map data correlates the light identifier with the location on the map corresponding to the location of the light source within the area.

* * * * *